US006744418B2

(12) United States Patent
Hiji et al.

(10) Patent No.: US 6,744,418 B2
(45) Date of Patent: Jun. 1, 2004

(54) CHOLESTERIC LIQUID CRYSTAL DISPLAY

(75) Inventors: Naoki Hiji, Ebina (JP); Shigeru Yamamoto, Ebina (JP); Takehito Hikichi, Ebina (JP); Teiichi Suzuki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 257 days.

(21) Appl. No.: 09/912,294

(22) Filed: Jul. 26, 2001

(65) Prior Publication Data

US 2002/0057239 A1 May 16, 2002

(30) Foreign Application Priority Data

Jul. 31, 2000 (JP) ..... 2000-230612

(51) Int. Cl.[7] ..... G09G 3/36
(52) U.S. Cl. ..... 345/94; 345/100
(58) Field of Search ..... 345/87–100

(56) References Cited

U.S. PATENT DOCUMENTS 5,748,277 A 5/1998 Huang et al.
5,805,130 A * 9/1998 Yamamoto et al. ..... 345/100
5,917,465 A * 6/1999 Mochizuki et al. ..... 345/94
6,118,425 A * 9/2000 Kudo et al. ..... 345/100
6,320,562 B1 * 11/2001 Ueno et al. ..... 345/87
6,414,669 B1 * 7/2002 Masazumi ..... 345/98

FOREIGN PATENT DOCUMENTS

EP 0 957 394 A1 11/1999
JP 7-49668 A 2/1995
JP 11-326871 A 11/1999

OTHER PUBLICATIONS

S.J. Rossendaal et al., "Fast Addresing of Cholesteric Texture Liquid Crystal Displays," SID 01 Digest, 32, 1268–1271(Jun. 5, 2001) ISSN 0001–0966X/01/3201–1268.

* cited by examiner

*Primary Examiner*—Xiao Wu
*Assistant Examiner*—Kevin Nguyen
(74) *Attorney, Agent, or Firm*—Oliff & Berridge, PLC

(57) ABSTRACT

A cholesteric liquid crystal display capable of rewriting at a high speed is provided, which includes a cholesteric liquid crystal display element forming pixels at intersection portions of scan-electrodes of a scan-electrode group and data-electrodes of a data-electrode group, in which L-lines (L: integer lager than 2) of the scan-electrodes each of the scan-electrode group form a block. The drive circuit sequentially selects one block during one selection time, simultaneously applies coded drive voltages each corresponding to the L-lines of the scan-electrodes in the selected block, and applies coded data-voltages each corresponding to data-electrodes of the data-electrode group synchronously with the drive voltages.

18 Claims, 19 Drawing Sheets

Tf

RESET TIME: Tr SELECTION TIME: Ts

| | | | | | | | | | | | | | | | | | |
|---|---|---|---|---|---|---|---|---|---|---|---|---|---|---|---|---|---|
| R1 | Vrh | Vrh | Vrh | Vrh | 0 | Vs | Vs | Vs | Vs | 0 | 0 | 0 | 0 | 0 | 0 | 0 | 0 |
| R2 | Vrh | Vrh | Vrh | Vrh | 0 | Vs | Vs | -Vs | -Vs | 0 | 0 | 0 | 0 | 0 | 0 | 0 | 0 |
| R3 | Vrh | Vrh | Vrh | Vrh | 0 | Vs | -Vs | Vs | -Vs | 0 | 0 | 0 | 0 | 0 | 0 | 0 | 0 |
| R4 | Vrh | Vrh | Vrh | Vrh | 0 | Vs | -Vs | -Vs | Vs | 0 | 0 | 0 | 0 | 0 | 0 | 0 | 0 |
| R5 | Vrh | Vrh | Vrh | Vrh | 0 | 0 | 0 | 0 | 0 | Vs | Vs | Vs | Vs | 0 | 0 | 0 | 0 |
| R6 | Vrh | Vrh | Vrh | Vrh | 0 | 0 | 0 | 0 | 0 | Vs | Vs | -Vs | -Vs | 0 | 0 | 0 | 0 |
| R7 | Vrh | Vrh | Vrh | Vrh | 0 | 0 | 0 | 0 | 0 | Vs | -Vs | Vs | -Vs | 0 | 0 | 0 | 0 |
| R8 | Vrh | Vrh | Vrh | Vrh | 0 | 0 | 0 | 0 | 0 | Vs | -Vs | -Vs | Vs | 0 | 0 | 0 | 0 |
| R9 | Vrh | Vrh | Vrh | Vrh | 0 | 0 | 0 | 0 | 0 | 0 | 0 | 0 | 0 | Vs | Vs | Vs | Vs |
| R10 | Vrh | Vrh | Vrh | Vrh | 0 | 0 | 0 | 0 | 0 | 0 | 0 | 0 | 0 | Vs | Vs | -Vs | -Vs |
| R11 | Vrh | Vrh | Vrh | Vrh | 0 | 0 | 0 | 0 | 0 | 0 | 0 | 0 | 0 | Vs | -Vs | Vs | -Vs |
| R12 | Vrh | Vrh | Vrh | Vrh | 0 | 0 | 0 | 0 | 0 | 0 | 0 | 0 | 0 | Vs | -Vs | -Vs | Vs |
| R13 | Vrh | Vrh | Vrh | Vrh | 0 | 0 | 0 | 0 | 0 | 0 | 0 | 0 | 0 | 0 | 0 | 0 | 0 |
| R14 | Vrh | Vrh | Vrh | Vrh | 0 | 0 | 0 | 0 | 0 | 0 | 0 | 0 | 0 | 0 | 0 | 0 | 0 |
| R15 | Vrh | Vrh | Vrh | Vrh | 0 | 0 | 0 | 0 | 0 | 0 | 0 | 0 | 0 | 0 | 0 | 0 | 0 |
| R16 | Vrh | Vrh | Vrh | Vrh | 0 | 0 | 0 | 0 | 0 | 0 | 0 | 0 | 0 | 0 | 0 | 0 | 0 |

L

FIG. 1

FULL REWRITE TIME: Tf

SELECTION TIME: Ts

L

| | | | | | | | | | | | | | | | | |
|---|---|---|---|---|---|---|---|---|---|---|---|---|---|---|---|---|
| R1 | Vs | Vs | Vs | Vs | 0 | 0 | 0 | 0 | 0 | 0 | 0 | 0 | 0 | 0 | 0 | 0 |
| R2 | Vs | Vs | -Vs | -Vs | 0 | 0 | 0 | 0 | 0 | 0 | 0 | 0 | 0 | 0 | 0 | 0 |
| R3 | Vs | -Vs | Vs | -Vs | 0 | 0 | 0 | 0 | 0 | 0 | 0 | 0 | 0 | 0 | 0 | 0 |
| R4 | Vs | -Vs | -Vs | Vs | 0 | 0 | 0 | 0 | 0 | 0 | 0 | 0 | 0 | 0 | 0 | 0 |
| R5 | 0 | 0 | 0 | 0 | Vs | Vs | Vs | Vs | 0 | 0 | 0 | 0 | 0 | 0 | 0 | 0 |
| R6 | 0 | 0 | 0 | 0 | Vs | Vs | -Vs | -Vs | 0 | 0 | 0 | 0 | 0 | 0 | 0 | 0 |
| R7 | 0 | 0 | 0 | 0 | Vs | -Vs | Vs | -Vs | 0 | 0 | 0 | 0 | 0 | 0 | 0 | 0 |
| R8 | 0 | 0 | 0 | 0 | Vs | -Vs | -Vs | Vs | 0 | 0 | 0 | 0 | 0 | 0 | 0 | 0 |
| R9 | 0 | 0 | 0 | 0 | 0 | 0 | 0 | 0 | Vs | Vs | Vs | Vs | 0 | 0 | 0 | 0 |
| R10 | 0 | 0 | 0 | 0 | 0 | 0 | 0 | 0 | Vs | Vs | -Vs | -Vs | 0 | 0 | 0 | 0 |
| R11 | 0 | 0 | 0 | 0 | 0 | 0 | 0 | 0 | Vs | -Vs | Vs | -Vs | 0 | 0 | 0 | 0 |
| R12 | 0 | 0 | 0 | 0 | 0 | 0 | 0 | 0 | Vs | -Vs | -Vs | Vs | 0 | 0 | 0 | 0 |
| R13 | 0 | 0 | 0 | 0 | 0 | 0 | 0 | 0 | 0 | 0 | 0 | 0 | Vs | Vs | Vs | Vs |
| R14 | 0 | 0 | 0 | 0 | 0 | 0 | 0 | 0 | 0 | 0 | 0 | 0 | Vs | Vs | -Vs | -Vs |
| R15 | 0 | 0 | 0 | 0 | 0 | 0 | 0 | 0 | 0 | 0 | 0 | 0 | Vs | -Vs | Vs | -Vs |
| R16 | 0 | 0 | 0 | 0 | 0 | 0 | 0 | 0 | 0 | 0 | 0 | 0 | Vs | -Vs | -Vs | Vs |

FIG. 3

Tf

SELECTION TIME: Ts

| | | | | | | | | | | | | | | | | |
|---|---|---|---|---|---|---|---|---|---|---|---|---|---|---|---|---|
| R1 | Vs | Vs | Vs | Vs | 0 | 0 | 0 | 0 | 0 | 0 | 0 | 0 | 0 | 0 | 0 | 0 |
| R2 | 0 | 0 | 0 | 0 | Vs | Vs | Vs | Vs | 0 | 0 | 0 | 0 | 0 | 0 | 0 | 0 |
| R3 | 0 | 0 | 0 | 0 | 0 | 0 | 0 | 0 | Vs | Vs | Vs | Vs | 0 | 0 | 0 | 0 |
| R4 | 0 | 0 | 0 | 0 | 0 | 0 | 0 | 0 | 0 | 0 | 0 | 0 | Vs | Vs | Vs | Vs |
| R5 | Vs | Vs | -Vs | -Vs | 0 | 0 | 0 | 0 | 0 | 0 | 0 | 0 | 0 | 0 | 0 | 0 |
| R6 | 0 | 0 | 0 | 0 | Vs | Vs | -Vs | -Vs | 0 | 0 | 0 | 0 | 0 | 0 | 0 | 0 |
| R7 | 0 | 0 | 0 | 0 | 0 | 0 | 0 | 0 | Vs | Vs | -Vs | -Vs | 0 | 0 | 0 | 0 |
| R8 | 0 | 0 | 0 | 0 | 0 | 0 | 0 | 0 | 0 | 0 | 0 | 0 | Vs | Vs | -Vs | -Vs |
| R9 | Vs | -Vs | Vs | -Vs | 0 | 0 | 0 | 0 | 0 | 0 | 0 | 0 | 0 | 0 | 0 | 0 |
| R10 | 0 | 0 | 0 | 0 | Vs | -Vs | Vs | -Vs | 0 | 0 | 0 | 0 | 0 | 0 | 0 | 0 |
| R11 | 0 | 0 | 0 | 0 | 0 | 0 | 0 | 0 | Vs | -Vs | Vs | -Vs | 0 | 0 | 0 | 0 |
| R12 | 0 | 0 | 0 | 0 | 0 | 0 | 0 | 0 | 0 | 0 | 0 | 0 | Vs | -Vs | Vs | -Vs |
| R13 | Vs | -Vs | -Vs | Vs | 0 | 0 | 0 | 0 | 0 | 0 | 0 | 0 | 0 | 0 | 0 | 0 |
| R14 | 0 | 0 | 0 | 0 | Vs | -Vs | -Vs | Vs | 0 | 0 | 0 | 0 | 0 | 0 | 0 | 0 |
| R15 | 0 | 0 | 0 | 0 | 0 | 0 | 0 | 0 | Vs | -Vs | -Vs | Vs | 0 | 0 | 0 | 0 |
| R16 | 0 | 0 | 0 | 0 | 0 | 0 | 0 | 0 | 0 | 0 | 0 | 0 | Vs | -Vs | -Vs | Vs |

FIG. 5

Tf

RESET TIME: Tr | SELECTION TIME: Ts

| | | | | | | | | | | | | | | | | | | | | | | | | | | |
|---|---|---|---|---|---|---|---|---|---|---|---|---|---|---|---|---|---|---|---|---|---|---|---|---|---|---|
| R1 | Vrh | Vrh | Vrh | Vrh | 0 | Vrf | Vrf | Vrf | Vrf | 0 | Vs | Vs | Vs | Vs | 0 | 0 | 0 | 0 | 0 | 0 | 0 | 0 | 0 | 0 | 0 | 0 |
| R2 | Vrh | Vrh | Vrh | Vrh | 0 | Vrf | Vrf | Vrf | Vrf | 0 | Vs | Vs | -Vs | -Vs | 0 | 0 | 0 | 0 | 0 | 0 | 0 | 0 | 0 | 0 | 0 | 0 |
| R3 | Vrh | Vrh | Vrh | Vrh | 0 | Vrf | Vrf | Vrf | Vrf | 0 | Vs | -Vs | Vs | -Vs | 0 | 0 | 0 | 0 | 0 | 0 | 0 | 0 | 0 | 0 | 0 | 0 |
| R4 | Vrh | Vrh | Vrh | Vrh | 0 | Vrf | Vrf | Vrf | Vrf | 0 | Vs | -Vs | -Vs | Vs | 0 | 0 | 0 | 0 | 0 | 0 | 0 | 0 | 0 | 0 | 0 | 0 |
| R5 | Vrh | Vrh | Vrh | Vrh | 0 | Vrf | Vrf | Vrf | Vrf | 0 | 0 | 0 | 0 | 0 | Vs | Vs | Vs | Vs | 0 | 0 | 0 | 0 | 0 | 0 | 0 | 0 |
| R6 | Vrh | Vrh | Vrh | Vrh | 0 | Vrf | Vrf | Vrf | Vrf | 0 | 0 | 0 | 0 | 0 | Vs | Vs | -Vs | -Vs | 0 | 0 | 0 | 0 | 0 | 0 | 0 | 0 |
| R7 | Vrh | Vrh | Vrh | Vrh | 0 | Vrf | Vrf | Vrf | Vrf | 0 | 0 | 0 | 0 | 0 | Vs | -Vs | Vs | -Vs | 0 | 0 | 0 | 0 | 0 | 0 | 0 | 0 |
| R8 | Vrh | Vrh | Vrh | Vrh | 0 | Vrf | Vrf | Vrf | Vrf | 0 | 0 | 0 | 0 | 0 | Vs | -Vs | -Vs | Vs | 0 | 0 | 0 | 0 | 0 | 0 | 0 | 0 |
| R9 | Vrh | Vrh | Vrh | Vrh | 0 | Vrf | Vrf | Vrf | Vrf | 0 | 0 | 0 | 0 | 0 | 0 | 0 | 0 | 0 | Vs | Vs | Vs | Vs | 0 | 0 | 0 | 0 |
| R10 | Vrh | Vrh | Vrh | Vrh | 0 | Vrf | Vrf | Vrf | Vrf | 0 | 0 | 0 | 0 | 0 | 0 | 0 | 0 | 0 | Vs | Vs | -Vs | -Vs | 0 | 0 | 0 | 0 |
| R11 | Vrh | Vrh | Vrh | Vrh | 0 | Vrf | Vrf | Vrf | Vrf | 0 | 0 | 0 | 0 | 0 | 0 | 0 | 0 | 0 | Vs | -Vs | Vs | -Vs | 0 | 0 | 0 | 0 |
| R12 | Vrh | Vrh | Vrh | Vrh | 0 | Vrf | Vrf | Vrf | Vrf | 0 | 0 | 0 | 0 | 0 | 0 | 0 | 0 | 0 | Vs | -Vs | -Vs | Vs | 0 | 0 | 0 | 0 |
| R13 | Vrh | Vrh | Vrh | Vrh | 0 | Vrf | Vrf | Vrf | Vrf | 0 | 0 | 0 | 0 | 0 | 0 | 0 | 0 | 0 | 0 | 0 | 0 | 0 | Vs | Vs | Vs | Vs |
| R14 | Vrh | Vrh | Vrh | Vrh | 0 | Vrf | Vrf | Vrf | Vrf | 0 | 0 | 0 | 0 | 0 | 0 | 0 | 0 | 0 | 0 | 0 | 0 | 0 | Vs | Vs | -Vs | -Vs |
| R15 | Vrh | Vrh | Vrh | Vrh | 0 | Vrf | Vrf | Vrf | Vrf | 0 | 0 | 0 | 0 | 0 | 0 | 0 | 0 | 0 | 0 | 0 | 0 | 0 | Vs | -Vs | Vs | -Vs |
| R16 | Vrh | Vrh | Vrh | Vrh | 0 | Vrf | Vrf | Vrf | Vrf | 0 | 0 | 0 | 0 | 0 | 0 | 0 | 0 | 0 | 0 | 0 | 0 | 0 | Vs | -Vs | -Vs | Vs |

L

FIG. 6

Tf

RESET TIME: Tr | SELECTION TIME: Ts

| | | | | | | | | | | | | | | | | | | | | | | | | | | |
|---|---|---|---|---|---|---|---|---|---|---|---|---|---|---|---|---|---|---|---|---|---|---|---|---|---|---|
| R1 | Vrh | Vrh | Vrh | Vrh | 0 | Vrf | Vrf | Vrf | Vrf | 0 | Vs | Vs | Vs | Vs | 0 | 0 | 0 | 0 | 0 | 0 | 0 | 0 | 0 | 0 | 0 | 0 |
| R2 | Vrh | Vrh | Vrh | Vrh | 0 | Vrf | Vrf | Vrf | Vrf | 0 | Vs | Vs | -Vs | -Vs | 0 | 0 | 0 | 0 | 0 | 0 | 0 | 0 | 0 | 0 | 0 | 0 |
| R3 | Vrh | Vrh | Vrh | Vrh | 0 | Vrf | Vrf | Vrf | Vrf | 0 | Vs | -Vs | Vs | -Vs | 0 | 0 | 0 | 0 | 0 | 0 | 0 | 0 | 0 | 0 | 0 | 0 |
| R4 | Vrh | Vrh | Vrh | Vrh | 0 | Vrf | Vrf | Vrf | Vrf | 0 | Vs | -Vs | -Vs | Vs | 0 | 0 | 0 | 0 | 0 | 0 | 0 | 0 | 0 | 0 | 0 | 0 |
| R5 | 0 | 0 | 0 | 0 | Vrh | Vrh | Vrh | Vrh | 0 | Vrf | Vrf | Vrf | Vrf | 0 | Vs | Vs | Vs | Vs | 0 | 0 | 0 | 0 | 0 | 0 | 0 | 0 |
| R6 | 0 | 0 | 0 | 0 | Vrh | Vrh | Vrh | Vrh | 0 | Vrf | Vrf | Vrf | Vrf | 0 | Vs | Vs | -Vs | -Vs | 0 | 0 | 0 | 0 | 0 | 0 | 0 | 0 |
| R7 | 0 | 0 | 0 | 0 | Vrh | Vrh | Vrh | Vrh | 0 | Vrf | Vrf | Vrf | Vrf | 0 | Vs | -Vs | Vs | -Vs | 0 | 0 | 0 | 0 | 0 | 0 | 0 | 0 |
| R8 | 0 | 0 | 0 | 0 | Vrh | Vrh | Vrh | Vrh | 0 | Vrf | Vrf | Vrf | Vrf | 0 | Vs | -Vs | -Vs | Vs | 0 | 0 | 0 | 0 | 0 | 0 | 0 | 0 |
| R9 | 0 | 0 | 0 | 0 | 0 | 0 | 0 | 0 | Vrh | Vrh | Vrh | Vrh | 0 | Vrf | Vrf | Vrf | Vrf | 0 | Vs | Vs | Vs | Vs | 0 | 0 | 0 | 0 |
| R10 | 0 | 0 | 0 | 0 | 0 | 0 | 0 | 0 | Vrh | Vrh | Vrh | Vrh | 0 | Vrf | Vrf | Vrf | Vrf | 0 | Vs | Vs | -Vs | -Vs | 0 | 0 | 0 | 0 |
| R11 | 0 | 0 | 0 | 0 | 0 | 0 | 0 | 0 | Vrh | Vrh | Vrh | Vrh | 0 | Vrf | Vrf | Vrf | Vrf | 0 | Vs | -Vs | Vs | -Vs | 0 | 0 | 0 | 0 |
| R12 | 0 | 0 | 0 | 0 | 0 | 0 | 0 | 0 | Vrh | Vrh | Vrh | Vrh | 0 | Vrf | Vrf | Vrf | Vrf | 0 | Vs | -Vs | -Vs | Vs | 0 | 0 | 0 | 0 |
| R13 | 0 | 0 | 0 | 0 | 0 | 0 | 0 | 0 | 0 | 0 | 0 | 0 | Vrh | Vrh | Vrh | Vrh | 0 | Vrf | Vrf | Vrf | Vrf | 0 | Vs | Vs | Vs | Vs |
| R14 | 0 | 0 | 0 | 0 | 0 | 0 | 0 | 0 | 0 | 0 | 0 | 0 | Vrh | Vrh | Vrh | Vrh | 0 | Vrf | Vrf | Vrf | Vrf | 0 | Vs | Vs | -Vs | -Vs |
| R15 | 0 | 0 | 0 | 0 | 0 | 0 | 0 | 0 | 0 | 0 | 0 | 0 | Vrh | Vrh | Vrh | Vrh | 0 | Vrf | Vrf | Vrf | Vrf | 0 | Vs | -Vs | Vs | -Vs |
| R16 | 0 | 0 | 0 | 0 | 0 | 0 | 0 | 0 | 0 | 0 | 0 | 0 | Vrh | Vrh | Vrh | Vrh | 0 | Vrf | Vrf | Vrf | Vrf | 0 | Vs | -Vs | -Vs | Vs |

L

FIG. 11A
*CONVENTIONAL ART*

$$L=2 \begin{pmatrix} 1 & 1 \\ 1 & -1 \end{pmatrix}$$

FIG. 11B
*CONVENTIONAL ART*

$$L=4 \begin{pmatrix} 1 & 1 & 1 & 1 \\ 1 & -1 & 1 & -1 \\ 1 & 1 & -1 & -1 \\ 1 & -1 & -1 & 1 \end{pmatrix}$$

FIG. 11C
*CONVENTIONAL ART*

$$L=8 \begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

FIG. 11D
*CONVENTIONAL ART*

$$L=16 \begin{pmatrix} 1 & 1 & 1 & 1 & 1 & 1 & 1 & 1 & 1 & 1 & 1 & 1 & 1 & 1 & 1 & 1 \\ 1 & -1 & 1 & -1 & 1 & -1 & 1 & -1 & 1 & -1 & 1 & -1 & 1 & -1 & 1 & -1 \\ 1 & 1 & -1 & -1 & 1 & 1 & -1 & -1 & 1 & 1 & -1 & -1 & 1 & 1 & -1 & -1 \\ 1 & -1 & -1 & 1 & 1 & -1 & -1 & 1 & 1 & -1 & -1 & 1 & 1 & -1 & -1 & 1 \\ 1 & 1 & 1 & 1 & -1 & -1 & -1 & -1 & 1 & 1 & 1 & 1 & -1 & -1 & -1 & -1 \\ 1 & -1 & 1 & -1 & -1 & 1 & -1 & 1 & 1 & -1 & 1 & -1 & -1 & 1 & -1 & 1 \\ 1 & 1 & -1 & -1 & -1 & -1 & 1 & 1 & 1 & 1 & -1 & -1 & -1 & -1 & 1 & 1 \\ 1 & -1 & -1 & 1 & -1 & 1 & 1 & -1 & 1 & -1 & -1 & 1 & -1 & 1 & 1 & -1 \\ 1 & 1 & 1 & 1 & 1 & 1 & 1 & 1 & -1 & -1 & -1 & -1 & -1 & -1 & -1 & -1 \\ 1 & -1 & 1 & -1 & 1 & -1 & 1 & -1 & -1 & 1 & -1 & 1 & -1 & 1 & -1 & 1 \\ 1 & 1 & -1 & -1 & 1 & 1 & -1 & -1 & -1 & -1 & 1 & 1 & -1 & -1 & 1 & 1 \\ 1 & -1 & -1 & 1 & 1 & -1 & -1 & 1 & -1 & 1 & 1 & -1 & -1 & 1 & 1 & -1 \\ 1 & 1 & 1 & 1 & -1 & -1 & -1 & -1 & -1 & -1 & -1 & -1 & 1 & 1 & 1 & 1 \\ 1 & -1 & 1 & -1 & -1 & 1 & -1 & 1 & -1 & 1 & -1 & 1 & 1 & -1 & 1 & -1 \\ 1 & 1 & -1 & -1 & -1 & -1 & 1 & 1 & -1 & -1 & 1 & 1 & 1 & 1 & -1 & -1 \\ 1 & -1 & -1 & 1 & -1 & 1 & 1 & -1 & -1 & 1 & 1 & -1 & 1 & -1 & -1 & 1 \end{pmatrix}$$

| | | | | |
|---|---|---|---|---|
| I1(t) | 1 | 1 | 1 | 1 |
| I2(t) | 1 | −1 | 1 | −1 |
| I3(t) | 1 | 1 | −1 | −1 |
| I4(t) | 1 | −1 | −1 | 1 |
| Σ Uili(t) | 0 | 4 | 0 | 0 |

×Vd

CHOLESTERIC LIQUID CRYSTAL DISPLAY

BACKGROUND OF THE INVENTION

1. Field of the Invention

The present invention relates to a cholesteric liquid crystal display used for a display panel in electronic equipment and a recording/display medium of images.

2. Discussion of the Related Art

The cholesteric liquid crystal display has attracted considerable attention in recent years as a display device for electronic paper such as electronic newspapers and electronic publications since it has the following advantages: being capable of utilizing reflection of surrounding lights to give a light display; having a storage property that holds display contents after the supply voltage is turned off; being capable of a large-capacity display by simple matrix drive utilizing the storage property; being capable of using a flexible substrate of a resin, etc., because an active matrix is not needed for the drive, and the like.

The cholesteric liquid crystal is made up of spirally oriented stick-like molecules, and exhibits a selective reflection phenomenon that reflects a light of a wavelength corresponding to a spiral pitch. The cholesteric liquid crystal display elements utilize this phenomenon. As an example of the sectional structure of this device is illustrated in FIG. 18, the device is made up of cells that sandwich a cholesteric liquid crystal 30 between two substrates 11, 12 each having interventional transparent electrodes 21, 22, and a light absorptive layer 41 that absorbs a selective reflection wavelength is attached on the opposite face to the cell observation side. The light absorptive layer 41 is presumed to be a black color hereunder.

The orientation of the cholesteric liquid crystal takes on three types, namely, planer (P) orientation, focal conic (F) orientation, and homeotropic (H) orientation, as shown in FIG. 17A through FIG. 17C. The P orientation is a state in which the spiral axis is oriented almost vertically to the substrate plane, which assumes a color according to a selective reflection wavelength. The F orientation is a state in which the spiral axis is oriented almost in parallel to the substrate plane, which is colorless, and the black color of the light absorptive layer 41 is observed. The H orientation is a state in which the spiral structure is decomposed and the molecules are oriented vertically to the substrate plane, which is also colorless, and the black color of the light absorptive layer 41 is observed.

When a voltage is applied across the transparent electrodes 21, 22, both the P orientation and the F orientation stably exist in the applied voltage lower than $V_{T1}$, showing a bi-stable state. When the voltage is increased, the F orientation does not change and the P orientation transitions gradually into the F orientation; and when the voltage is over $V_{T2}$, the state completely transitions into the F orientation. When a still higher voltage than $V_{T3}$ is applied, the state is starting to transition into the H orientation, and when the voltage is over $V_{T4}$, it completely transitions into the H orientation. Even though the applied voltage is sharply removed from the state of the F orientation, the F orientation is maintained; however, when the voltage is sharply removed from the state of the H orientation, it transitions into the P orientation.

As a result of the above transition characteristic, the measurement of the reflectance after a specific time from when the voltage is applied only for the time T as shown in FIG. 20 gives the voltage vs. reflectance characteristic as shown in FIG. 21. That is, when the initial orientation is the P orientation, the characteristic shows a high reflectance under $V_{T1}$; in the range over $V_{T1}$ under $V_{T2}$, the reflectance gradually lowers; in the range over $V_{T2}$ under $V_{T3}$, the characteristic shows a low reflectance; in the range over $V_{T3}$ under $V_{T4}$, the reflectance increases; and over $V_{T4}$, it shows a high reflectance, which is the same as that in the initial orientation. On the other hand, when the initial orientation is the F orientation, the characteristic shows a low reflectance under $V_{T3}$; in the range over $V_{T3}$ under $V_{T4}$, the reflectance increases; and over $V_{T4}$, it shows a high reflectance.

The above voltage vs. reflectance characteristic varies depending upon the time T during which the voltage is applied. When the initial orientation is the P orientation, as shown in FIG. 23, the whole voltage vs. reflectance characteristic shifts to a higher voltage side as the time T becomes shorter, and in the range over $V_{T2}$ under $V_{T3}$, the reflectance increases. This is because the transition into the F orientation becomes incomplete by the time T becoming shorter to create a state in which the F orientation and the P orientation are microscopically mixed. On the other hand, when the initial orientation is the F orientation, as shown in FIG. 22, $V_{T4}$ shifts to a higher voltage side as the time T becomes shorter, and the range over $V_{T3}$ under $V_{T4}$ expands.

Utilizing the above voltage vs. reflectance characteristic, the cholesteric liquid crystal display is able to write image data by means of the simple matrix electrodes serving intersection portions of scan-electrodes and data-electrodes as pixels. As an example, FIG. 19 illustrates a plan configuration of a simple matrix panel having 16×16 pixels. As shown in the drawing, the panel contains a scan-electrode group 23 made up of $R_1$ to $R_{16}$ and a data-electrode group 24 made up of $C_1$ to $C_{16}$.

As a method of driving the cholesteric liquid crystal display elements, for example, the write method named as the FCR (ForcalConic Reset) method is disclosed in the Japanese Published Unexamined Patent Application No. Hei 11-326871. This method executes writing by a drive voltage made up of a reset time for making the pixels transition into the F orientation and a selection time for writing the P orientation, in which a drive voltage to make the pixels simultaneously transition into the F orientation is applied to all the scan-electrodes during the reset time, and next a selected voltage is applied to the scan-electrodes one by one sequentially.

FIG. 9 illustrates a timing chart of the drive voltage that is applied to the scan-electrode group 23 having 16 electrodes as an example. As in the drawing, during the reset time Tr, the method gives a voltage Vrh over $V_{T4}$ to make the pixels transition into the H orientation, thereafter brings the voltage once to zero, next gives a voltage Vrf being over $V_{T2}$ under $V_{T3}$ and again brings to zero to thereby attain the F orientation. During that time, the voltage given to the data-electrode group 24 is zero. During the selection time Ts, the method gives the voltage Vs of $(V_{T3}+V_{T4})/2$ to the scan-electrodes, and simultaneously gives a data voltage of $(V_{T3}-V_{T4})/2$ or $(-V_{T3}+V_{T4})/2$ to the data-electrodes. Thereby, $V_{T4}$ or $V_{T3}$ being the difference of the scan-voltage and the data voltage is applied to the pixels, which makes the pixels selectively transition into the P orientation or the F orientation. The voltage applied to the scan-electrodes is zero except the reset time Tr and the selection time Ts.

While selecting a scan-electrode, the method applies the data voltage $(V_{T3}-V_{T4})/2$ or $(-V_{T3}+V_{T4})/2$ to a pixel on another scan-electrode. To condition the data voltage as $|(V_{T3}-V_{T4})/2|<V_{T1}$ will permit writing the data in all the pixels without varying the reflectance of the already written pixels. Assuming that the number of the scanning lines is N, the full write time Tf is given by the following expression 1.

$$Tf=Tr+N\times Ts \quad \text{[Expression 1]}$$

Another method is disclosed in the specification of the U.S. Pat. No. 5,748,277, which is named as the DDS (Dynamic Drive Scheme) method. The DDS method takes on the drive voltage waveform, which is made up a series of reset time Tr, selection time Ts, and hold time Th, as shown in FIG. 24. During the reset time Tr, a voltage Vrh is applied to make the pixels transition into the H orientation. During the selection time Ts, a voltage Vs is applied to select maintaining the H orientation or starting transition into the P orientation. During the hold time Th, a voltage Vh is applied to maintain the H orientation and to make the P orientation transition into the F orientation. When the voltage Vs is selected so as to maintain the H orientation, after removing the hold voltage Vh, the liquid crystal transitions into the P orientation to assume a high reflectance. On the other hand, when the voltage Vs is selected so as to start transition into the P orientation, the liquid crystal transitions into the F orientation to assume a low reflectance. FIG. 25 illustrates the voltage vs. reflectance characteristic with regard to the voltage Vh, in Vs=0 and Vs=Vh. In Vs=0, the characteristic becomes equal to that in case of the initial orientation being the P orientation. In Vs=Vh, the characteristic assumes a shape such that the characteristic in Vs=0 is shifted to a lower voltage side. The voltage Vh is selected to be over $V_{T5}$ under $V_{T3}$. The voltage vs. reflectance characteristic with regard to the voltage Vs is as shown in FIG. 26, and the reflectance can be controlled within the range over $V_{T6}$ under $V_{T7}$.

This drive method can be applied to a simple matrix panel. FIG. 10 illustrates a timing chart of the drive voltage that is applied to the scan-electrode group 23 having 16 electrodes as an example. The method applies a drive voltage Vrh, Vs, Vh corresponding to the reset time Tr, selection time Ts, hold time Th to the scan-electrodes sequentially with a shifted timing of the selection time length Ts. During the selection time Ts, the method gives the voltage $(V_{T6}+V_{T7})/2$ to the scan-electrodes, and to synchronize with it, gives the voltage $(V_{T6}-V_{T7})/2$ or $-(V_{T6}-V_{T7})/2$ to the data-electrodes. Thereby, $V_{T6}$ or $V_{T7}$ being the difference of the scan-voltage and the data voltage is applied to the pixels, which makes the pixels selectively transition into the P orientation or the F orientation. To set the data voltage as $|(V_{T6}-V_{T7})/2|<V_{T1}$ will permit writing the data in all the pixels without varying the reflectance of the already written pixels. The full write time Tf is given by the following expression 2.

$$Tf=Tr+N\times Ts+Th \quad \text{[Expression 2]}$$

Both the FCR method and the DDS method utilize the storage property of the cholesteric liquid crystal, and write in the pixels on the next scan-electrodes without varying the reflectance of the already written pixels. Thereby, the both methods allow a large-capacity display that does not limit the number of the scan-electrodes.

However, both the FCR method and the DDS method inevitably increase the full write time Tf, as the number of the scan-electrodes increases. That is, the second term in the [expressing 1] and [expression 2], N×Ts, makes a dominant contribution. Normally, the length of the selection time Ts is 1 to 10 ms/line in the FCR method, and 0.3 to some ms/line in the DDS method, although it cannot be specified without reservations, since it depends on the physical constant, cell parameter, applied voltage, and so forth. When the number of the scanning lines is 1000, for example, the rewrite time is 1 to 10 sec in the FCR method, and 0.3 to some sec in the DDS method. In a low temperature, it takes time of several times more, due to the rise of the viscosity of a liquid crystal. This rewrite time cannot necessarily be said sufficiently short depending on the applications, and a still more shortening of the rewrite time has been desired.

In case of the FCR method, the length of the selection time Ts depends on the viscosity, orientation elasticity constant, and dielectric anisotropy, etc., of a liquid crystal, however there have been limits to improvements by these physical constants. Further, as shown in FIG. 22, a rise of the drive voltage will shorten the selection time, however it will cause a cost increase in the drive circuit, a yield decrease by short-circuits between the electrodes, and an increase in the power consumption. Further, shortening of the selection time by increasing the drive voltage will effect the applied voltage $|(V_{T3}-V_{T4})/2|$ to the data-electrodes to exceed $V_{T1}$, leading to creating crosstalks, which is a problem. In case of the DDS method, the length of the selection time is determined by the physical constants of the viscosity and orientation elasticity constant of a liquid crystal and the like, however there have been limits to a shortening of the selection time by these.

SUMMARY OF THE INVENTION

The present invention has been made in view of the above circumstances, and provides a cholesteric liquid crystal display capable of rewriting at a high speed.

According to one aspect of the invention, the cholesteric liquid crystal display includes cholesteric liquid crystal display elements forming pixels at intersection portions of a scan-electrode group and a data-electrode group; and a drive circuit that sequentially selects scan-electrodes of the scan-electrode group as a block made up of plural scan-electrodes, simultaneously applies coded drive voltages each corresponding to the plural scan-electrodes in the block in a selection time, and applies coded data-voltages each corresponding to data-electrodes of the data-electrode group synchronously with the drive voltages.

Here, as the drive voltages to be used may be those that have, during a time over 50% of the selection time, a peak value equal to or higher than a voltage that makes the pixels transition into the homeotropic orientation, and are coded by means of an orthogonal function or a substantially orthogonal function. The orthogonal function to be used may be one that takes +1 and −1 as elements, however it is not limited to this. Further, the data-voltages may take on those that are coded by multiplying an orthogonal function or a substantially orthogonal function by pixel data values.

The selection time can be made to include plural orthogonal cycles that represent a time for satisfying an orthogonal condition of the orthogonal function. The response time of a liquid crystal to an effective voltage that is applied to the pixels within the selection time is equal to or longer than one the orthogonal cycles, and equal to or shorter than the selection time. Further, the effective voltage applied to the pixels within a non-selection time is smaller than a threshold voltage that allows maintenance of a bi-stable state with the planer orientation and a focal conic orientation.

Further, a reset time for making the pixels transition into an initial orientation may be provided before the selection time. The reset time is given simultaneously to all the blocks, or it is given to each block sequentially with a shifted timing. Further, a hold time for supporting a transition into a final orientation state may be provided after the selection time. The block is made up of plural spatially separated scan-electrodes, not of plural adjoining scan-electrodes.

According to another aspect of the invention, the image-writing device that writes images in cholesteric liquid crystal display elements forming pixels at intersection portions of a scan-electrode group and a data-electrode group includes an orthogonal function generating circuit that generates an orthogonal function; a scan-voltage composing circuit that generates scan-voltages by level-shifting the orthogonal function, the scan-voltages are sequentially applied to every plural scan-electrodes of the scan-electrode group; and a data-voltage composing circuit that generates data-voltages by level-shifting a value of multiplying the orthogonal function by a pixel data value, the data-voltages are applied to data-electrodes of the data-electrode group. To this image-writing device may be provided a scan-electrode driver capable of applying the scan-voltages to every plural spatially separated scan-electrodes of the scan-electrode group. The device may also be provided with a reset waveform generating circuit that applies a reset waveform through the scan-voltage composing circuit and the data-voltage composing circuit, before applying the scan-voltages. Further, applying a waveform having an arbitrary phase shift as the pixel data value will make it possible to display the gradations.

According to another aspect of the invention, the method of writing images in cholesteric liquid crystal display elements forming pixels at intersection portions of a scan-electrode group and a data-electrode group includes the steps of selecting sequentially scan-electrodes of the scan-electrode group as a block made up of plural scan-electrodes, applying simultaneously coded drive voltages each corresponding to the plural scan-electrodes in the selected block, and applying coded data-voltages each corresponding to data-electrodes of the data-electrode group synchronously with the drive voltages. Here, the drive voltages may be attained by level-shifting the orthogonal function that takes +1 and −1 as elements.

With the above construction, the present invention achieves simultaneous writing of images in L-lines of the scan-electrodes (L: integer larger than 2). Thereby, the length of the selection time can be shortened to substantially 1/L at maximum. Therefore, the rewrite time can be reduced as a whole, which makes it possible to provide a cholesteric liquid crystal display capable of rewriting at a high speed.

BRIEF DESCRIPTION OF THE DRAWINGS

Preferred embodiments of the present invention will be described in detail based on the followings, wherein:

FIG. 1 is a timing chart of the voltages given to the scan-electrodes in one embodiment of a cholesteric liquid crystal display according to the invention;

FIG. 3 is a timing chart of the voltages given to the scan-electrodes in another embodiment of a cholesteric liquid crystal display according to the invention;

FIG. 5 is a timing chart of the voltages given to the scan-electrodes in another embodiment of a cholesteric liquid crystal display according to the invention;

FIG. 6 is a timing chart of the voltages given to the scan-electrodes in another embodiment of a cholesteric liquid crystal display according to the invention;

FIG. 11A through FIG. 11D are charts each illustrating examples of the orthogonal function employed in the invention;

DETAILED DESCRIPTION OF PREFERRED EMBODIMENTS

The preferred embodiments of the cholesteric liquid crystal display according to the invention will be described, in the case of the number of the scan-electrodes being 16.

<First Embodiment>

FIG. 1 is a timing chart of the voltages given to the scan-electrodes in one embodiment relating to the cholesteric liquid crystal display. In this embodiment, 16 scan-electrodes $R_1$ through $R_{16}$ are divided into four blocks, each of which is made up of four scan-electrodes (=L). A drive voltage is sequentially applied to each block for the selection time Ts. One block is selected for one selection time Ts, and the drive voltage Vs (or −Vs) is applied simultaneously to the four scan-electrodes in the selected block. Zero voltage is applied to the scan-electrodes in the blocks not selected. Therefore, the full rewrite time Tf becomes equal to 4× selection time Ts.

To prevent crosstalks between the scan-electrodes in the block, a coded drive voltage (having a time series pattern) is applied which is made up of an orthogonal function Ii(t) with +1 and −1 as the elements. Here, i signifies the i-th scan-electrode of L scan-electrodes forming one block. Since Ii(t) is an orthogonal function, the following relation is satisfied.

$$\int Ii(t)\cdot Ij(t)dt=0(i\neq j) \qquad \text{[Expression 3]}$$

FIG. 11A through FIG. 11D illustrate examples of the orthogonal function in L=2, 4, 8, 16. FIG. 11 illustrates the Hadamard matrix, in which the row direction represents the time and the column direction represents the scan-electrode. FIG. 11 takes a square matrix of L row L column, however it is not necessarily a square matrix as long as the orthogonal relation by the expression 3 is satisfied. Since the matrix in FIG. 11 maintains the above orthogonal relation, with regard to the replacement of a column by another arbitrary column or the polarity inversion in an arbitrary row, a function with such an operation having been executed may be used for Ii(t). FIG. 11 illustrates examples of the power of 2 as to L, however it is possible to make an orthogonal function except for the power of 2 such as L=6 or L=7, by selecting arbitrary six or seven orthogonal functions among the orthogonal functions of L=8. The L pieces of elements in the time axis direction are sequentially applied with the voltages in which the time Ts/L is stipulated as a unit time. Any waveform such as a sine waveform, triangular waveform, saw tooth waveform can be used, as long as the polarity thereof is inverted each other. However, the waveforms illustrated here are preferable to maximize the effective value of the voltage.

Figure 12A:
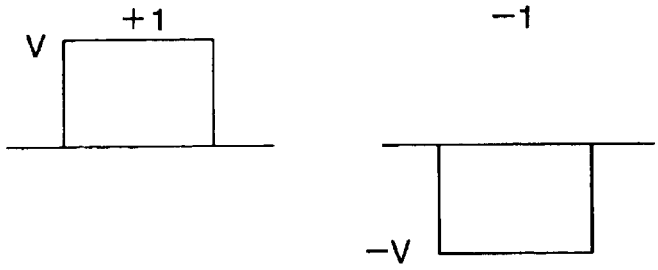
FIG. 12A and FIG. 12B are charts each explaining the relations between the orthogonal function and the voltage waveform.
Figure 12B:
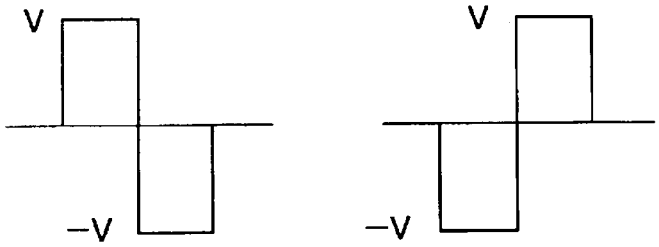

As a waveform of an actually applied voltage corresponding to the elements +1 and −1 of the orthogonal function can be used a dc rectangular waveform with the polarity inverted as in FIG. 12A, and a symmetric rectangular waveform with the polarity inverted as shown in FIG. 12B. Or, a burst waveform made up of a symmetric rectangular waveform with the polarity inverted may be used. A long time application of a dc voltage to the cholesteric liquid crystal will invite a drift of the threshold voltage and a deterioration of the liquid crystal, and it is accordingly preferable that the time average of the selected voltage waveform within the selection time is set to zero. Therefore, when using the dc rectangular waveform in FIG. 12A, it is preferable to use an orthogonal function that satisfies the relation $\int(t=0\ Ts)Ii(t)dt=0$. Further, when using the symmetric rectangular waveform in FIG. 12B, this condition is automatically satisfied. Therefore, an orthogonal function that satisfies $\int(t=0Ts)Ii(t)dt\neq 0$ may be used.

The drive voltage Ri(t) applied to the i-th scan-electrode of the L scan-electrodes simultaneously selected is given as a value of the orthogonal function Ii(t) multiplied by Vs. On the other hand, a data voltage C(t) synchronously applied to the data-electrodes is given as a sum in i=1L of a value that the orthogonal function Ii(t) is multiplied by a pixel data value Ui.

$$Ri(t)=Vs\cdot Ii(t)\quad C(t)=\Sigma(i=1\ L)Ui\cdot Ii(t) \qquad \text{[Expression 4]}$$

The voltage {Ri(t)−C(t)} is applied to a pixel on the i-th scan-electrode during the selection time. Therefore, the effective voltage Vi applied to the pixel during the selection time is equal to $Vi=\{1/Ts\cdot\int(Ri(t)-C(t))^2dt\}^{1/2}$. The range of integration is [0, Ts]. Here, $$\int(Ri(t)-C(t))^2dt=\int Ri(t)^2dt+\int C(t)^2dt-2\int Ri(t)\cdot C(t)dt \qquad \text{[Expression5]}$$

$$\text{First term}=Vs^2\int Ii(t)^2dt=Vs^2\cdot Ts$$

$$\text{Second term}=\int\{\Sigma Ui\cdot Ii(t)\}^2dt=Ts\cdot\Sigma Ui^2$$

$$\text{Third term}=-2Vs\cdot\int Ii(t)\cdot\Sigma Ui\cdot Ij(t)dt=-2Vs\cdot Ui\cdot Ts$$

Therefore, Vi is given by the following.

$$Vi=\{Vs^2+\Sigma Ui^2-2Vs\cdot Ui\}^{1/2}$$

Ui is selected so that the absolute value thereof becomes equal to a constant value Vd regardless of the display image information. That is, if Ui takes +Vd or −Vd, the second term will become $L\cdot Vd^2$. Therefore, if Vs and Vd are maintained to be constant during the selection time, Vi will be determined uniquely by Ui, which theoretically allows removal of crosstalks between the scan-electrodes that are simultaneously selected. If the maximum value of Vi is given by Von and the minimum value thereof is given by Voff, Von and Voff will be given as follows.

$$Von=\{Vs^2+L\cdot Vd^2+2Vs\cdot Vd\}^{1/2}\quad(Ui=-Vd)$$

$$Voff=\{Vs^2+L\cdot Vd^2-2Vs\cdot Vd\}^{1/2}\quad(Ui=Vd)$$

These are written approximately by the followings.

$$Von=\{(Vs+\sqrt{L}\cdot Vd)^2+2(1-\sqrt{L})\cdot Vs\cdot Vd\}^{1/2}\sim(Vs+\sqrt{L}\cdot Vd)+(1-\sqrt{L})\cdot Vs\cdot Vd/(Vs+\sqrt{L}\cdot Vd)$$

$$Voff=\{(Vs+\sqrt{L}\cdot Vd)^2-2(1+\sqrt{L})\cdot Vs\cdot Vd\}^{1/2}\sim(Vs+\sqrt{L}\cdot Vd)-(1+\sqrt{L})\cdot Vs\cdot Vd/(Vs+\sqrt{L}\cdot Vd)$$

Therefore, by giving +Vd or −Vd to Ui, $$Von-Voff=2Vs\cdot Vd/(Vs+\sqrt{L}\cdot Vd), \qquad \text{[Expression 6]}$$

and the difference of the effective voltage by the expression 6 can be given to the pixel. If the approximation $Vs\gg\sqrt{L}\cdot Vd$ is met, Von−Voff2Vd is given. In case a reflectance variation occurs between certain threshold voltages $V_{TL}$ and $V_{TH}$, setting to satisfy $Voff<V_{TL}$, $V_{TH}<Von$ will allow writing the images. Since (Von−Voff) decreases as L increases, setting to satisfy $(Von-Voff)>(V_{TH}-V_{TL})$ will restrict the upper limit of L. The above has been explained as to pixels on a certain data-electrode, however the explanation is applicable in the same manner to pixels on the other data-electrodes.

Figure 14:
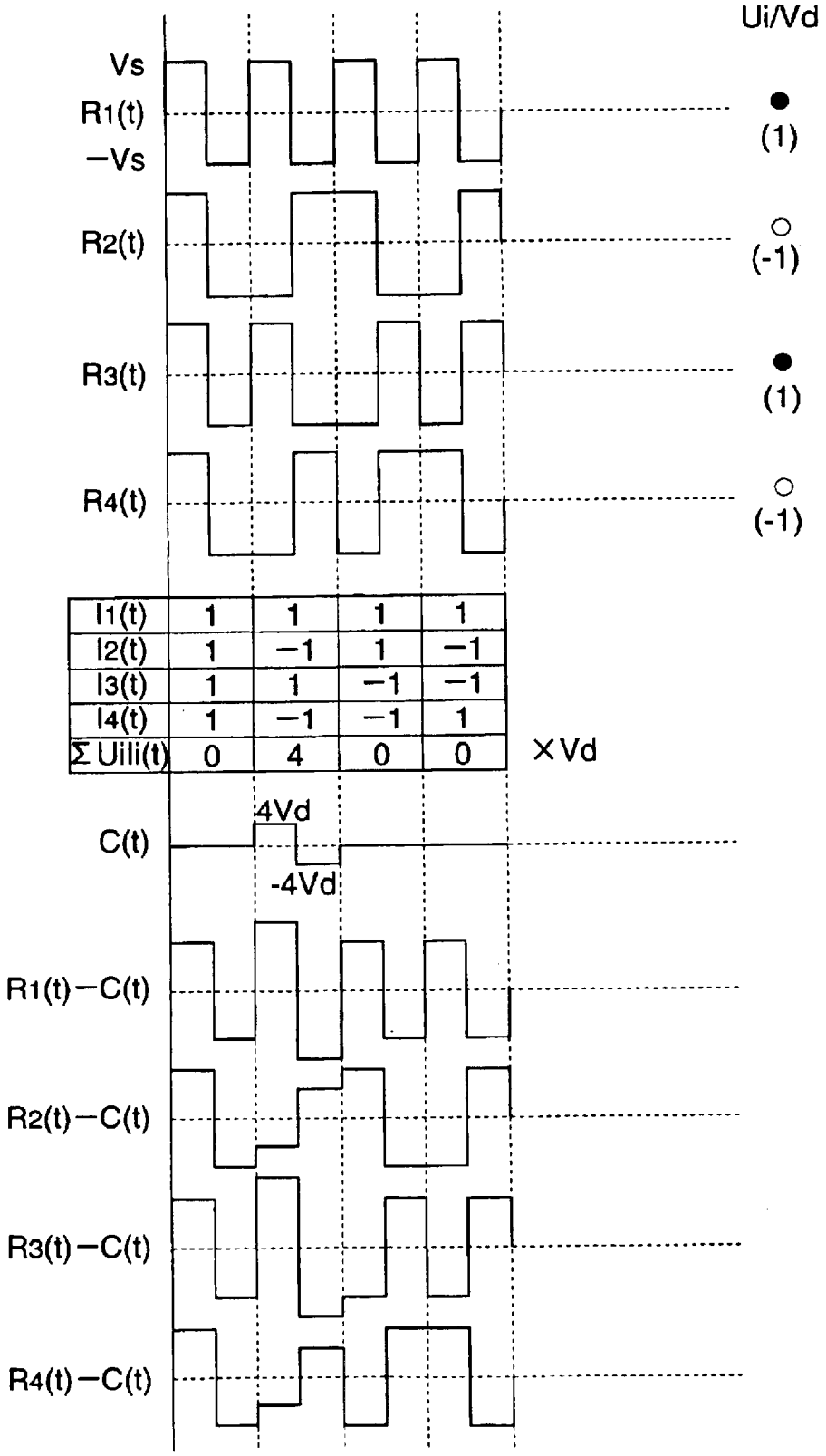
FIG. 14 is a chart illustrating one example of the voltage waveforms applied to the scan-electrodes and the data-electrodes during the selection time in one block.

FIG. 14 illustrates one example of the voltage waveforms applied to the scan-electrodes and the data-electrodes during the selection time in one block. In this example, when the dark, light, dark, light images each are written in the pixels made up of the intersection portions of a data-electrode and the scan-electrodes in the order of i=1, 2, 3, 4, the drawing illustrates the timing of the waveforms applied to the scan-electrodes and the data-electrode. Here, $U_1$=Vd, $U_2$=−Vd, $U_3$=Vd, and $U_4$=−Vd are assumed to be set in correspondence with the image information. As the orthogonal function, the matrix in L=4 shown in FIG. 11B is used, and the symmetric rectangular waveforms shown in FIG. 12B are brought in correspondence with the orthogonal function elements +1 and −1. As C(t), the expression 4 gives a waveform that varies with time in 0→4 Vd→0→0. To apply this waveform to the data-electrode will produce the above display pattern.

It is preferable to provide the orthogonal relation with the elements +1 and −1, from the view point that the effective value of the drive voltages applied to the scan-electrodes during the selection time can be made maximum, and the circuit can be simplified. However, as long as the orthogonal relation is satisfied, even if it includes other elements than these, it is possible to simultaneously write in the pixels on plural scan-electrodes. However, since the inclusion of the other elements than +1 and −1 lowers the effective voltage, an extension of the selection time becomes necessary in order to compensate the lowering of the effective voltage. In order not to produce such demerits, the drive voltage applied to the scan-electrodes during the selection time is required to have a peak-to-peak value that is higher than the voltage for transitioning into the homeotropic orientation when the voltage is applied for a sufficiently long time, more than at least 50% of the selection time.

Also in regard to the orthogonal relation, if $$\int(t=0\ \ Ts)Ii(t)\cdot Ij(t)dt<0.2\ \ (i\neq j)$$

is met, the relation substantially satisfies the orthogonal function. Assuming that the drive voltages outputted to the simultaneously selected i-th and j-th scan-electrodes are given by Vsi(t) and Vsj(t), the above relation can be written in general as follows.

$$\int(t=0\ \ Ts)Vsi(t)\cdot Vsj(t)dt/\sqrt{\{\int(t=0\ \ Ts)Vsi(t)^2\cdot\int(t=0\ \ Ts)Vsj(t)^2dt\}}<0.2\ \ (i\neq j)$$

This is the necessary condition to approximately regard the orthogonal relation as the orthogonal function.

Now, the drive method that applies drive voltage waveforms made by an orthogonal function simultaneously to plural scan-lines (hereunder, named as plural scan-line simultaneous drive method) is disclosed, for example, in the Japanese Published Unexamined Patent Application No. Hei 7-49668, which is already known in the STN LCD. However, there are two points that differentiate the present invention from the STN LCD, as follows.

The first point lies in the relation between the length of the selection time and the response speed. In the STN LCD, since the orientation change during the selection time causes the lowering of contrast by the frame response, the relation is selected in such a manner that the response speed of a liquid crystal is higher than the selection time. In this invention, on the other hand, the length of the selection time and the applied voltage are selected in such a manner that the response speed of a liquid crystal becomes equivalent to the selection time or lower, so as to complete a necessary orientation change for acquiring the final orientation state within one full selection time. Here, "to complete a necessary orientation change" does not mean to complete the change of reflectance within the selection time. When rewriting the pixels in the F orientation into the P orientation, for example, since the transition from the F orientation into the H orientation is completed within the selection time, the H orientation spontaneously transitions into the P orientation after completing the selection time, whereby the desired P orientation can be obtained. The necessary orientation change signifies this sort of prodromal orientation change. Further, as in the case of setting a reset time described later, if the orientation change occurs substantially only when either Von or Voff is applied, the response time is needed to take only the part into consideration, in which the orientation change occurs.

However, the response time of a liquid crystal is needed to be longer than a cycle that completes the above orthogonal relation (hereunder, referred to as the orthogonal cycle). If the orthogonal cycle is made up of four unit times, for example, when the response speed is as high as the transition from the F orientation into the H orientation completes within the two unit times for the first half, the hysteresis effects to maintain the H orientation regardless of the magnitude of the applied voltage in the two unit times for the latter half. Accordingly, the orientation is brought into a state that is not determined uniquely to the effective voltage within the selection time, which creates crosstalks between the scan-electrodes simultaneously selected. The foregoing relation is the same with regard to the response between the other orientations. Therefore, the relation is preferably set so as to meet the following relation.

$$\text{orthogonal cycle}\leqq\text{response time}\leqq\text{selection time}\qquad\text{[Expression 7]}$$

Figure 2:
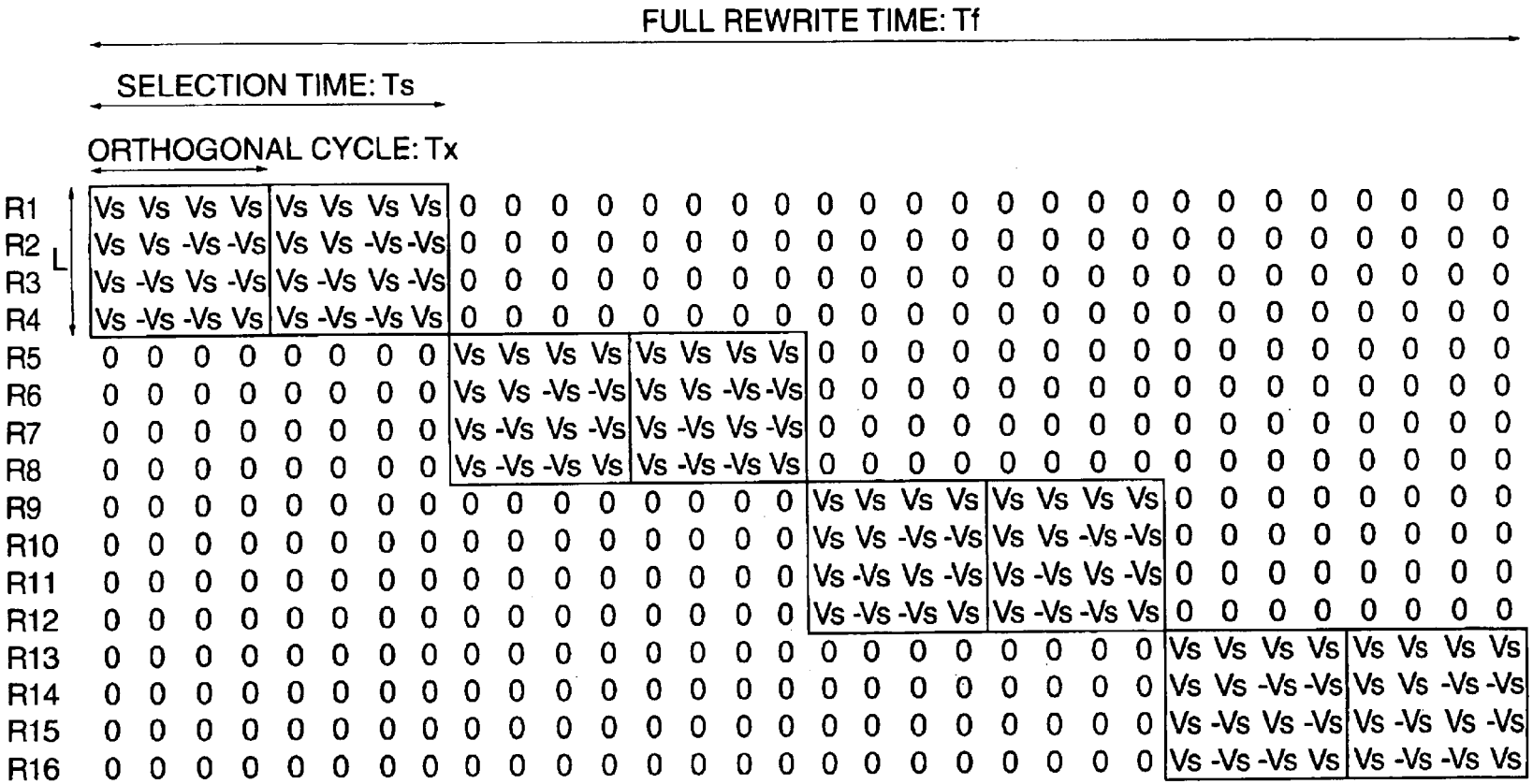
FIG. 2 is a timing chart of the voltages given to the scan-electrodes in another embodiment of a cholesteric liquid crystal display according to the invention.

In the case of FIG. 1, since the orthogonal cycle is equal to the selection time, the relation is needed to set so as to be the response time=orthogonal cycle=selection time. As a way to expand the margin of this setting, it is recommendable to decide the orthogonal function so as to include plural orthogonal cycles within the selection time. FIG. 2 is a timing chart illustrating an example in which the selection time Ts includes two times of the orthogonal cycles Tx.

In general, the response time of a liquid crystal is a function of an applied voltage. The response time in [expression 7] is the response time to an effective voltage in the selection time. In this invention, since the peak-to-peak voltage fluctuates with time in the selection time, a precaution is necessary so as not to respond to the fluctuations of the voltage. The maximum peak value of the voltage applied to the pixels is (Vs+L·Vd), and the minimum peak value thereof is (Vs−L·Vd), which are applied within the time Ts/L. Therefore, L, Vd, Vs have to be set so that the response time to these applied voltages becomes greater than Ts/L. From this viewpoint, it is preferable to set these so that Vs becomes sufficiently greater than L·Vd.

In the STN LCD, the average effective voltage within one-frame time that is applied thereto controls the reflectance. In this invention in contrast, the average effective voltage within the selection time that is applied thereto controls the reflectance. In the first place, since the cholesteric liquid crystal has the storage property, the reflectance cannot be determined uniquely to the voltage effective value as the STN LCD. However, defining the relation in regard to the orthogonal cycle and the response time and the selection time as mentioned above, and delimiting the period that takes the voltage effective value to the selection time will make it possible to associate the effective voltage with the reflectance. This is the unique point of this invention.

The second point that differentiates the drive method in the invention from the plural scan-line simultaneous drive method in the STN LCD lies in that, utilizing the storage property of the cholesteric liquid crystal, the invention sets the voltage so as not to rewrite the already written pixels, when writing in pixels. To the pixels on the blocks not selected is applied the following effective voltage.

$$\{\int C(t)^2 dt/Ts\}^{1/2}=\sqrt{L}\cdot Vd$$

This voltage is applied to the pixels on the first block for the longest time, which is Tf−Ts. Therefore, in order not to vary the reflectance of the pixel that is already written, Vd and L are necessary to be set so as to meet the following relation.

$$\sqrt{L}\cdot Vd<V_{T1}(T=Tf-Ts)$$

Here, $V_{T1}$(T=Tf−Ts) is $V_{T1}$ at the time T=Tf−Ts during which the voltage is applied.

Figure 15:
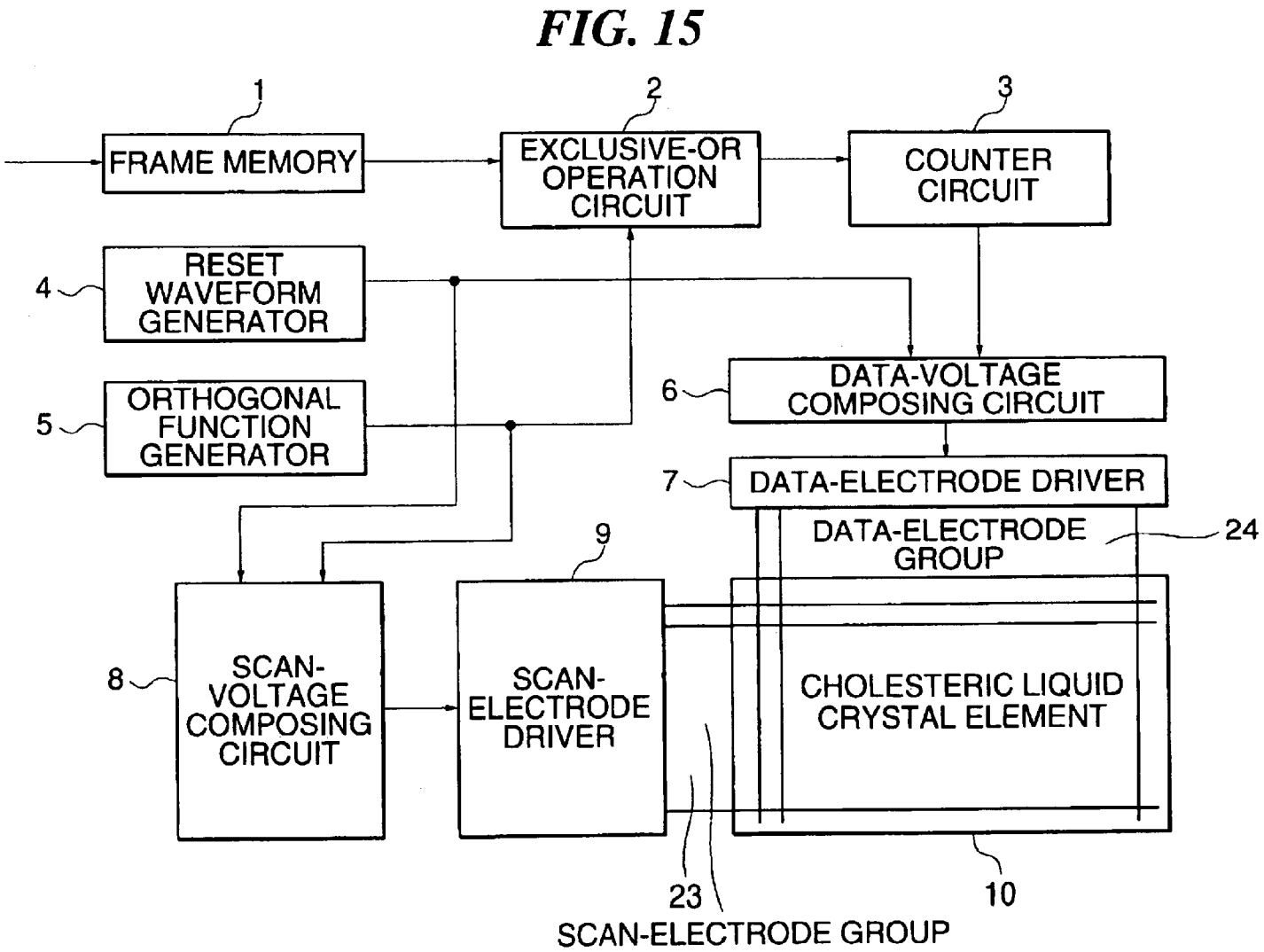
FIG. 15 is a block diagram illustrating one example of an image data write-in device for the cholesteric liquid crystal display according to the invention.

FIG. 15 illustrates one example of a drive circuit (image data write-in device) that applies the above voltages to the scan-electrode group 23 and the data-electrode group 24. In the drawing, a frame memory 1 stores display data for one image plane, and an orthogonal function generator 5 generates the orthogonal function Ii(t). Ui takes +Vd or −Vd, and (Ui/Vd) becomes equal to +1 or −1, accordingly. (Ui/Vd)·Ii(t) becomes equal to 1, if (Ui/Vd)=−1 and Ii(t)=−1, or (Ui/Vd)=1 and Ii(t)=1; and (Ui/Vd) Ii(t) becomes equal to −1, if (Ui/Vd)=−1 and Ii(t)=1, or (Ui/Vd)=1 and Ii(t)=−1. This means to execute the exclusive-OR operation that gives 1 when the signs of (Ui/Vd) and Ii(t) coincide, and gives −1 when they do not coincide.

The exclusive-OR operation circuit 2 acquires a display data for one block from the frame memory 1, and operates the exclusive-OR with the orthogonal function. From the difference of the coincidence and non-coincidence of the signs of (Ui/Vd) and Ii(t) acquired from the above exclusive-OR operation, a counter circuit 3 calculates C(t)/Vd=Σ(Ui/Vd)·Ii(t). The above calculation result is level-shifted to Vd times by a data-voltage composing circuit 6, and the result is applied to the data-electrode group 24 of a cholesteric liquid crystal display 10 through a data-electrode driver 7. On the other hand, the orthogonal function generated by the orthogonal function generator 5 is level-shifted to Vs times by a scan-voltage composing circuit 8, and the result is applied to the scan-electrode group 23 of the cholesteric liquid crystal display 10 through a scan-electrode driver 9. If the reset time is set before the selection time, which will be mentioned later, a reset waveform generated by a reset waveform generator 4 is applied to the scan-electrode group 23 and the data-electrode group 24 of the cholesteric liquid crystal display 10 through the data-voltage composing circuit 6 and the scan-voltage composing circuit 8.

The cholesteric liquid crystal display 10 is made up of the cholesteric liquid crystal 30 sandwiched between the two substrates 11 and 12 each including the scan-electrode group 23 and the data-electrode group 24, and the light absorptive layer 41 that absorbs a selective wavelength, which is attached on the opposite face to the observation side. The substrates 11, 12 can take on the translucent dielectric substance, for example, a glass, and a resin of polycarbonate, polyethylene terephthalate, and polyether sulphone. The scan-electrode group 23 and the data-electrode group 24 employ the translucent conductive material, for example, a conductive oxide such as ITO (Indium Tin Oxide), $SnO_2$, ZnO:Al, and a conductive resin such as polypyrrole and polyaniline, etc.

These materials can be formed into films by means of the vapor deposition method, spattering method, ion plating method, sol-gel method, coating method, printing method, electrodeposition method, or the like. To the translucent material is applied a patterning treatment by the printing method while forming a film, and after forming the film, the material is formed into a desired shape by means of the lithography method.

The cholesteric liquid crystal 30 can employ the nematic liquid crystal compositions such as cyanobiphenyl system, phenylcyclohexyl system, phenylbenzoate system, cyclohexylbenzoate system, azomethine system, azobenzene system, pyrimidine system, dioxane system, cyclohexylcyclohexane system, tolane system, etc., having the chiral compounds made of cholesterol derivatives or compounds having the optically active group such as the dimethyl butyl group added, and it can employ the liquid crystal chiral compounds. The cholesteric liquid crystal 30 may have additives such as pigments and fine grains added. The cholesteric liquid crystal 30 may be one that is dispersed into the polymer matrix, and one that is made into the polymer gel or capsule. Further, it may be any of the polymer liquid crystal, medium molecular liquid crystal, and low molecular liquid crystal, or it may be a mixture of these. The selective reflection wavelength of the cholesteric liquid crystal 30 may select not only one from the visible light wavelength range from 400 to 800 nm, but one from the near infrared wavelength range within which the scattering-transmission type cholesteric liquid crystal display operates. The cell gap is assumed to be normally within 2 to 20 $\mu$m, and the ratio of the cell gap d against the spiral pitch p of the cholesteric liquid crystal 30, d/p, is assumed to be equal to 2 to 30.

Between the cholesteric liquid crystal 30 and the scan-electrode group 23 and/or the data-electrode group 24 may be inserted as the orientation film a resin such as polyimide, an inorganic deposited film such as SiO, or a silane system or ammonia system surface modifier. The light absorptive layer 41 can take one that absorbs the selective reflection wavelength, and can appropriately select the color tone in view of the display effect. As the material thereof, paints including dyes and pigments, metal deposited films, and metal oxide films can be used. When the selective reflection wavelength is selected out of the near infrared wavelength range, a black color material may be used as the light absorptive layer 41, or anything may not be used, or a light reflective layer may be used instead of the light absorptive layer 41.

Further, the cholesteric liquid crystal display elements used in this invention may be one that can provide a color filter with each pixel, or color cholesteric liquid crystal display elements formed by laminating plural cholesteric liquid crystal display elements having different selective reflection wavelengths.

Further, setting Vs and Vd so as to meet Von=$V_{T4}$ and Voff=$V_{T3}$ will make the pixels selectively transition into the P orientation or the F orientation regardless of the stored orientation state.

In this embodiment, either the response time from the F orientation to the H orientation or the response time from the P orientation to the F orientation is required to be set longer than the orthogonal cycle, and to be set shorter than the selection time. The response time differs depending upon the elasticity constant and viscosity of the liquid crystal, and the applied voltage to the liquid crystal, which is normally some ten Ms.

<Second Embodiment>

FIG. 3 is a timing chart of the voltages given to the scan-electrodes in the second embodiment of the cholesteric liquid crystal display. This embodiment assumes as one block the scan-electrode in the order of i, (i+4), (i+8), (i+12), namely, i, (i+L), (i+2L), . . . (i+nL) (here, i is an integer smaller than L; n is an integer). In this manner, the scan-electrode block can be selected from spatially separated scan-electrodes.

Figure 16:
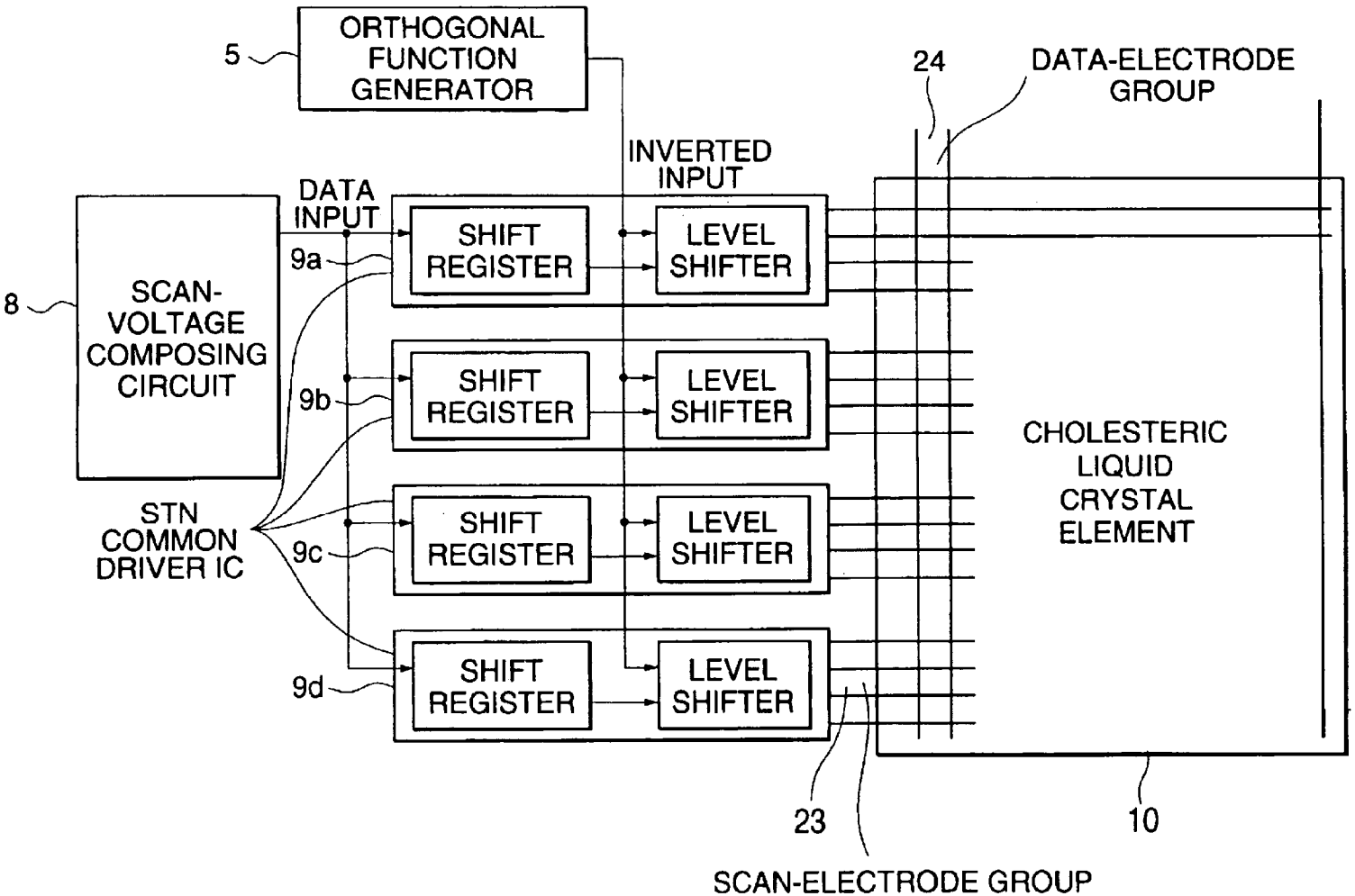
FIG. 16 is a block diagram illustrating one example of a scan circuit for the cholesteric liquid crystal display according to the invention.
Figure 17A:
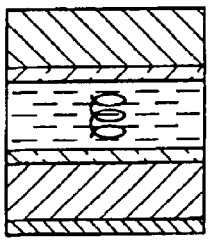
FIG. 17A CONVENTIONAL ART
FIG. 17A through FIG. 17C are sectional views of the cholesteric liquid crystal, each explaining the orientations.
Figure 17B:
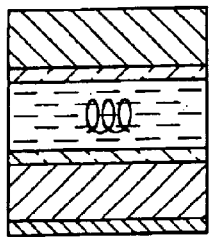
FIG. 17B CONVENTIONAL ART
Figure 17C:
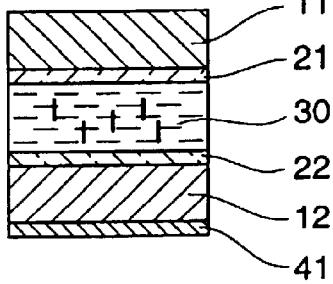
FIG. 17C CONVENTIONAL ART
Figure 18:
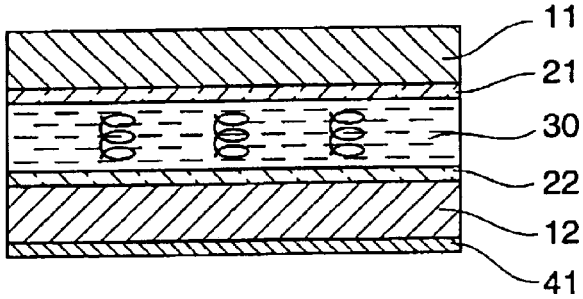
FIG. 18 is a sectional view illustrating one example of the cholesteric liquid crystal element.
Figure 19:
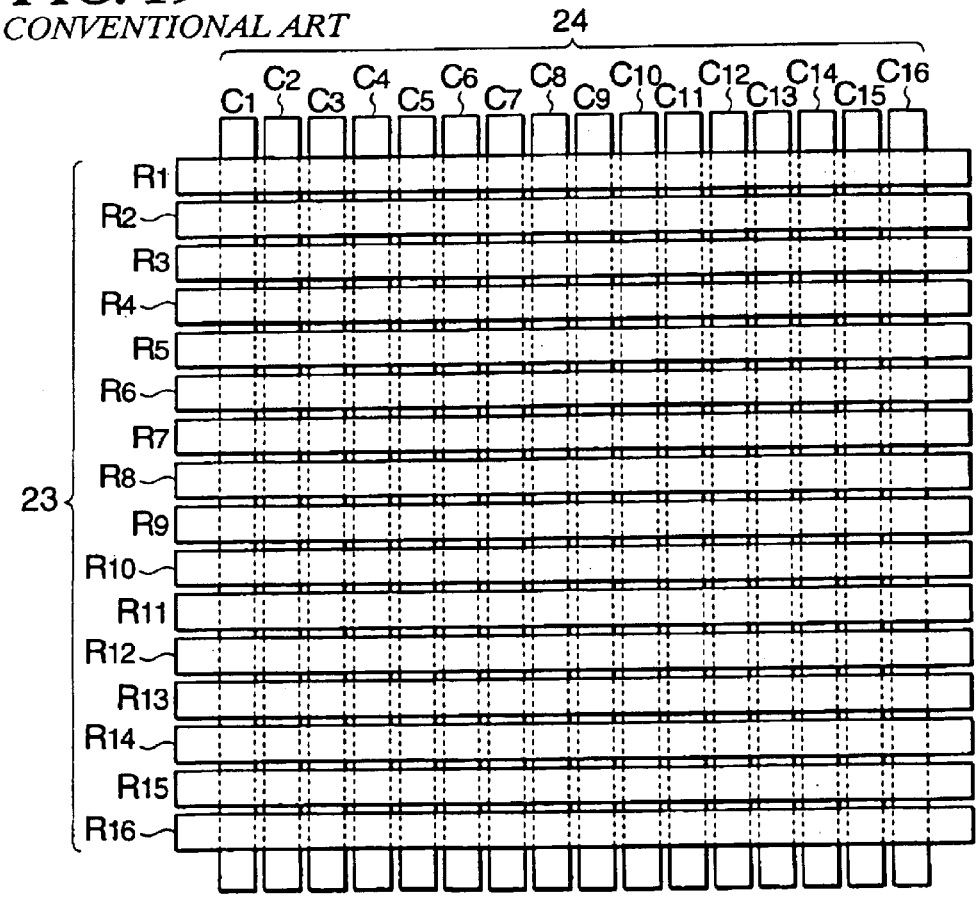
FIG. 19 CONVENTIONAL ART
FIG. 19 is a chart illustrating a plan configuration of a simple matrix panel.
Figure 20:
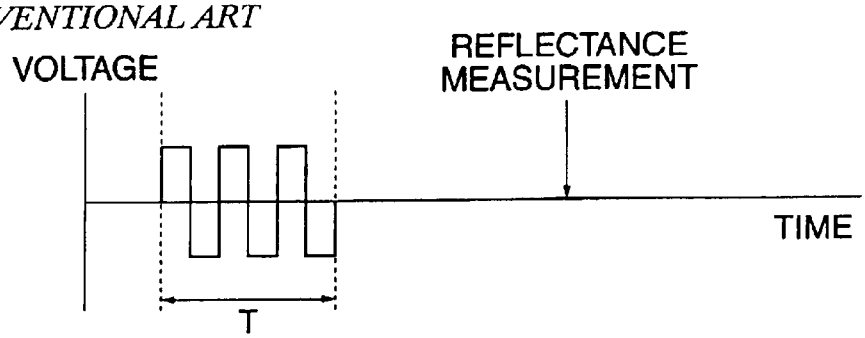
FIG. 20 CONVENTIONAL ART
FIG. 20 is a chart explaining the applied waveform and measuring timing for measuring a voltage vs. reflectance characteristic.

Since the scan-block is configured as above, this embodiment can use an STN common driver IC available on the market for the drive circuit. FIG. 16 illustrates a block diagram of the scan circuit relating to this embodiment. As shown in the drawing, generally the STN common driver ICs 9*a*, 9*b*, 9*c*, 9*d* each include a shift register and a level shifter. The level shifter is provided with a polarity inversion terminal that inverts the polarity of the output voltage. In this embodiment, the STN common driver ICs 9*a*, 9*b*, 9*c*, 9*d* are connected to each block, and the scan-voltage composing circuit 8 supplies a one-bit selection signal to each of the data inputs of the shift registers of the driver ICs 9*a*, 9*b*, 9*c*, 9*d* to thereby shift all the blocks in parallel one-bit each by the selection time Ts. The output polarity of each driver IC is made to vary at the time Ts/L each, in accordance with the output of the orthogonal function generator 5. Such a procedure will achieve the timing chart shown in FIG. 3. According to this embodiment, the STN common driver IC on the market can be used, and the cholesteric liquid crystal display can be made up at low cost.

<Third Embodiment>

Figure 4:
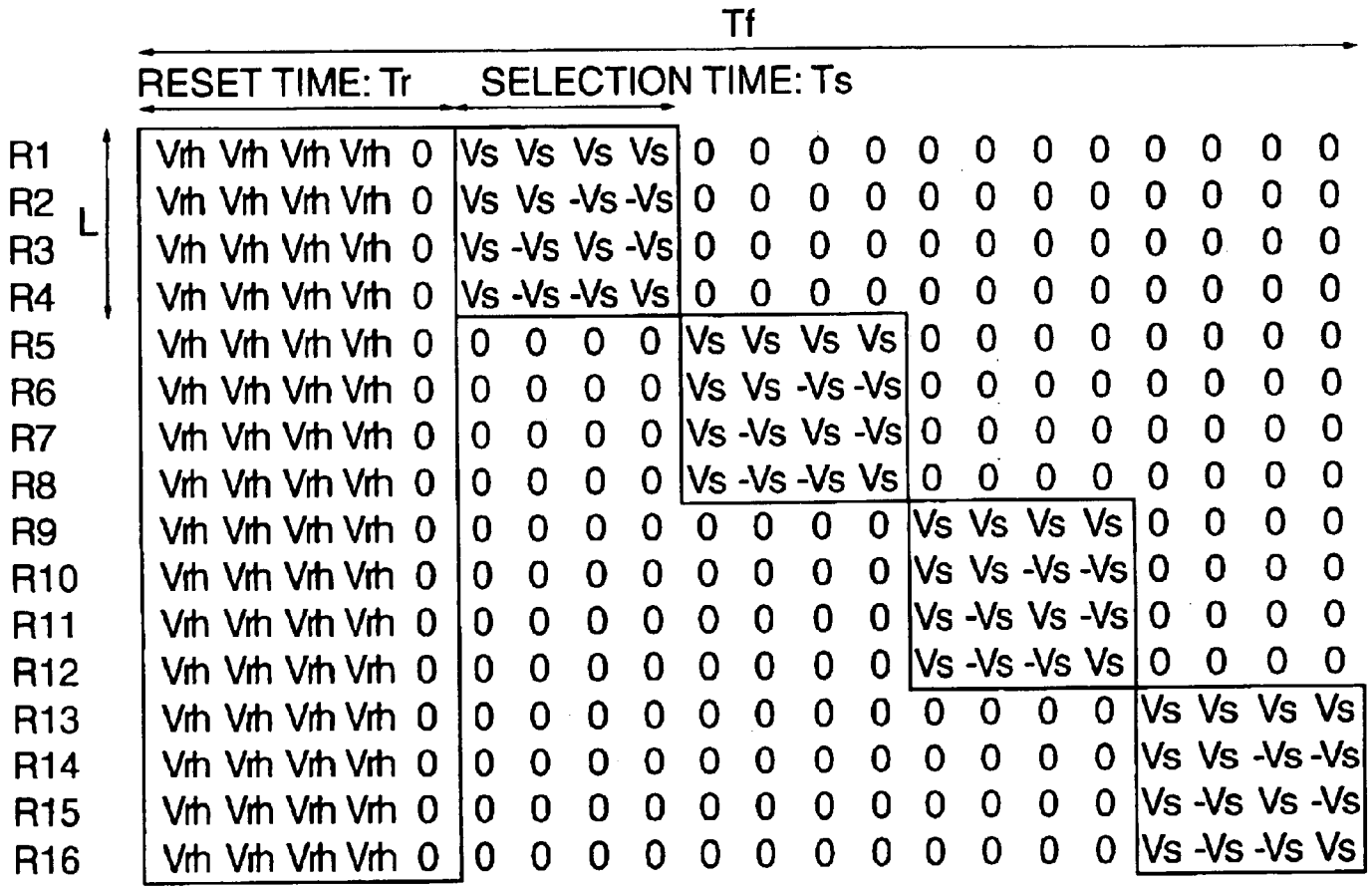
FIG. 4 is a timing chart of the voltages given to the scan-electrodes in another embodiment of a cholesteric liquid crystal display according to the invention.

FIG. 4 is a timing chart of the voltages given to the scan-electrodes in the third embodiment of the cholesteric liquid crystal display. This embodiment provides, before the selection time Ts, the reset time Tr for making the pixels transition into the P orientation. The reset time Tr includes a time for applying a voltage Vrh higher than $V_{T4}$ and a period for applying zero voltage. Thereby, the state transitions first into the H orientation and then into the P orientation. During the reset time Tr, the drive voltage is simultaneously applied to all the scan-electrodes $R_1$ to $R_{16}$, and zero voltage is applied to the data-electrodes. During the selection time Ts, the F orientation is written sequentially by each block in the setting of Von=$V_{T2}$ and Voff=$V_{T1}$.

In this embodiment, the response time from the P orientation to the F orientation is required to be set longer than the orthogonal cycle, and to be set shorter than the selection time. The response time differs depending upon the elasticity constant and viscosity of the liquid crystal, and the applied voltage to the liquid crystal, which is normally some ten ms.

Figure 25:
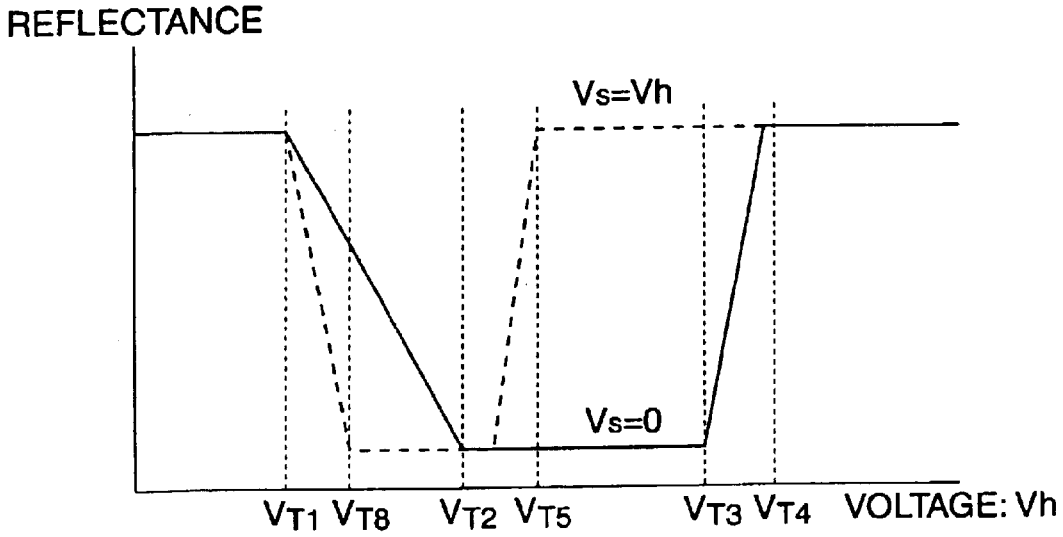
FIG. 25 CONVENTIONAL ART
FIG. 25 is a chart illustrating a voltage vs. reflectance characteristic, in the initial orientation being the H orientation and the P orientation.
Figure 26:
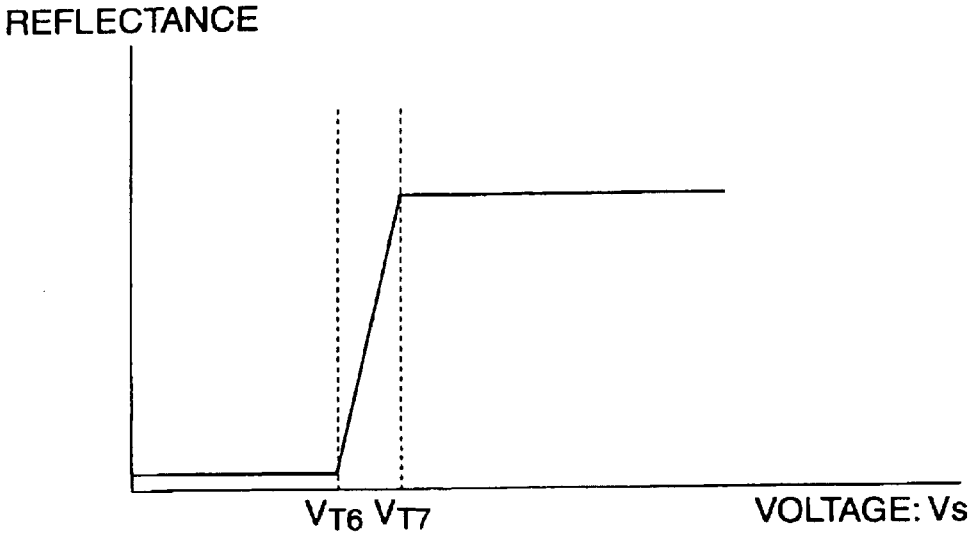
FIG. 26 CONVENTIONAL ART
FIG. 26 is a chart illustrating a voltage vs. reflectance characteristic in the DDS method.

The transition from the H orientation into the P orientation is known to progress by way of a long-pitch planer orientation named as the transient planer (TP) orientation; however, the period for applying zero voltage is needed to take the time for transitioning from the H orientation into the TP orientation, and normally about 1 ms is sufficient. The transition from the H orientation into the P orientation normally requires some hundred ms to complete, however it is not necessary to wait for the completion. In the case of not setting this period, the first block is made to transition from the H orientation directly into the F orientation, however the blocks after the second are made to transition from the H orientation by way of the TP orientation and then into the F orientation. As shown in FIG. 25, the voltage vs. reflectance characteristic differs in these two cases, and there occurs display non-uniformity in a transition from the first block into the other blocks. As mentioned above, the provision of the period for applying zero voltage at the end of the reset time will prevent this display non-uniformity.

Figure 21:
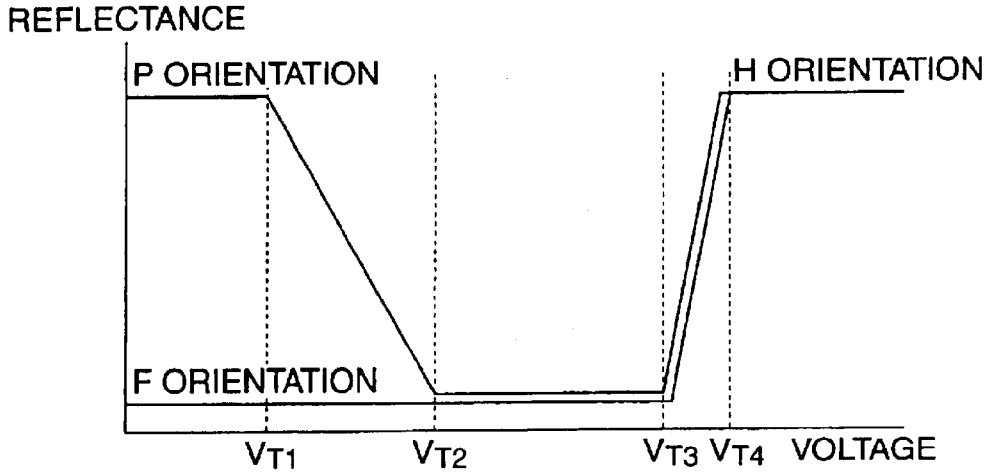
FIG. 21 CONVENTIONAL ART
FIG. 21 is a chart illustrating a voltage vs. reflectance characteristic of a cholesteric liquid crystal.

As shown in FIG. 21, the reflectance slightly differs in the voltage ranging from $V_{T3}$ to $V_{T4}$, depending on whether the initial orientation is the P orientation or the F orientation. Therefore, in the case of the writing method that does not provide the reset time, as in the first embodiment, the previously written image resides as an after image. According to this embodiment, since all the pixels are reset once into the P orientation, it is ensured to attain images without after images.

<Fourth Embodiment>

FIG. 5 is a timing chart of the voltages given to the scan-electrodes in the fourth embodiment of the cholesteric liquid crystal display. This embodiment provides, before the selection time Ts, the reset time Tr for making the pixels transition into the F orientation. The reset time Tr further includes the followings:

1) period for applying the voltage Vrh higher than $V_{T4}$ to make all the pixels transition into the H orientation,
2) period for applying zero voltage to start transition into the P orientation,
3) period for applying the voltage Vrf ranging from $V_{T2}$ to $V_{T3}$ to make the pixels transition into the F orientation, and
4) period for applying zero voltage.

The voltage applied to the data-electrodes during this reset time Tr is set to zero. After the state is reset to the F orientation, the P orientation is written sequentially by each block in the setting of Von=$V_{T4}$ and Voff=$V_{T3}$.

In this embodiment, the response time from the F orientation to the H orientation is required to be set longer than the orthogonal cycle, and to be set shorter than the selection time. The response time differs depending upon the elasticity constant and viscosity of the liquid crystal, and the applied voltage to the liquid crystal, which is normally some ms to some ten ms.

Figure 22:
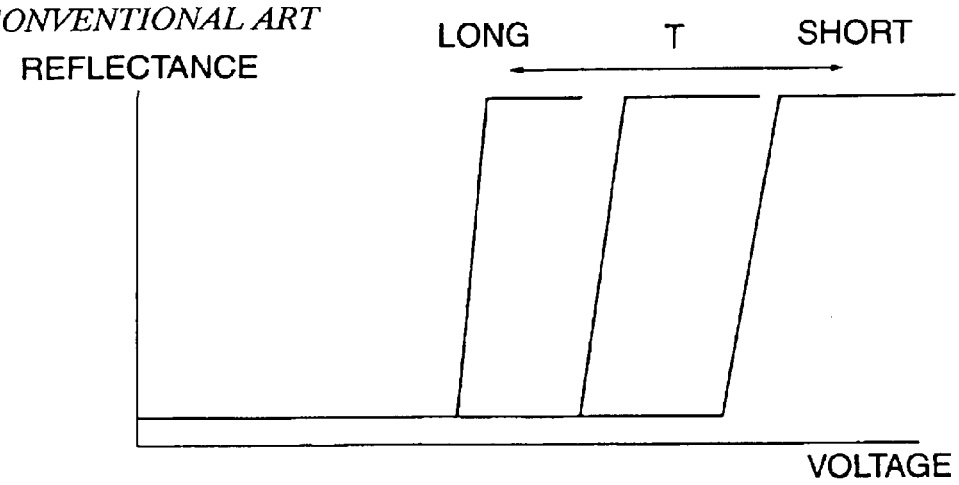
FIG. 22 CONVENTIONAL ART
FIG. 22 is a chart explaining a change of a voltage vs. reflectance characteristic depending on a voltage-applied time, in the initial orientation being the F orientation.
Figure 23:
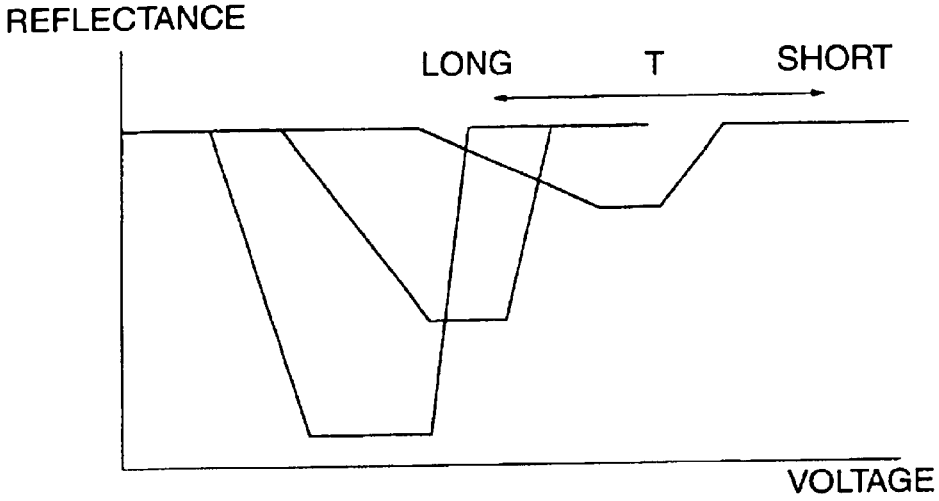
FIG. 23 CONVENTIONAL ART
FIG. 23 is a chart explaining a change of a voltage vs. reflectance characteristic depending on a voltage-applied time, in the initial orientation being the P orientation.
Figure 24:
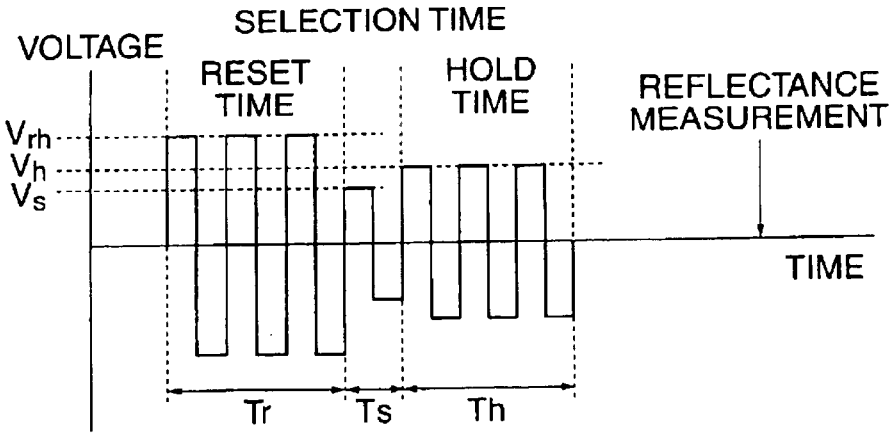
FIG. 24 CONVENTIONAL ART
FIG. 24 is a chart illustrating a time series pattern of a drive voltage in the DSS method.

As shown in FIG. 22 and FIG. 23, the reflectance in the F orientation cannot be brought to a sufficiently low level, unless the voltage application time is comparably long. However, the reflectance in the P orientation can be brought to a high level, as long as the applied voltage is sufficiently high, although the voltage application time is comparably short. Therefore, writing the P orientation sequentially after resetting to the F orientation as in this embodiment is preferable, compared with writing the F orientation sequentially after resetting to the P orientation as in the third embodiment, from the point that the selection time Ts can be made shorter and the contrast can be made higher.

<Fifth Embodiment>

FIG. 6 is a timing chart of the voltages given to the scan-electrodes in the fifth embodiment of the cholesteric liquid crystal display. This embodiment provides, before the selection time Ts, the reset time Tr for making the pixels transition into the F orientation, which is the same as the fourth embodiment. However, a series of drive voltages are applied sequentially to each block with a shifted timing of the selection time Ts, which is different from the fourth embodiment.

In the fourth embodiment, after the whole image is once erased, a new image gradually appears from the end of the image plane; however in this embodiment, a new image appears from the end of the image plane with the previous image remaining. This embodiment is able to exhibit such a different display effect.

<Sixth Embodiment>

Figure 7:
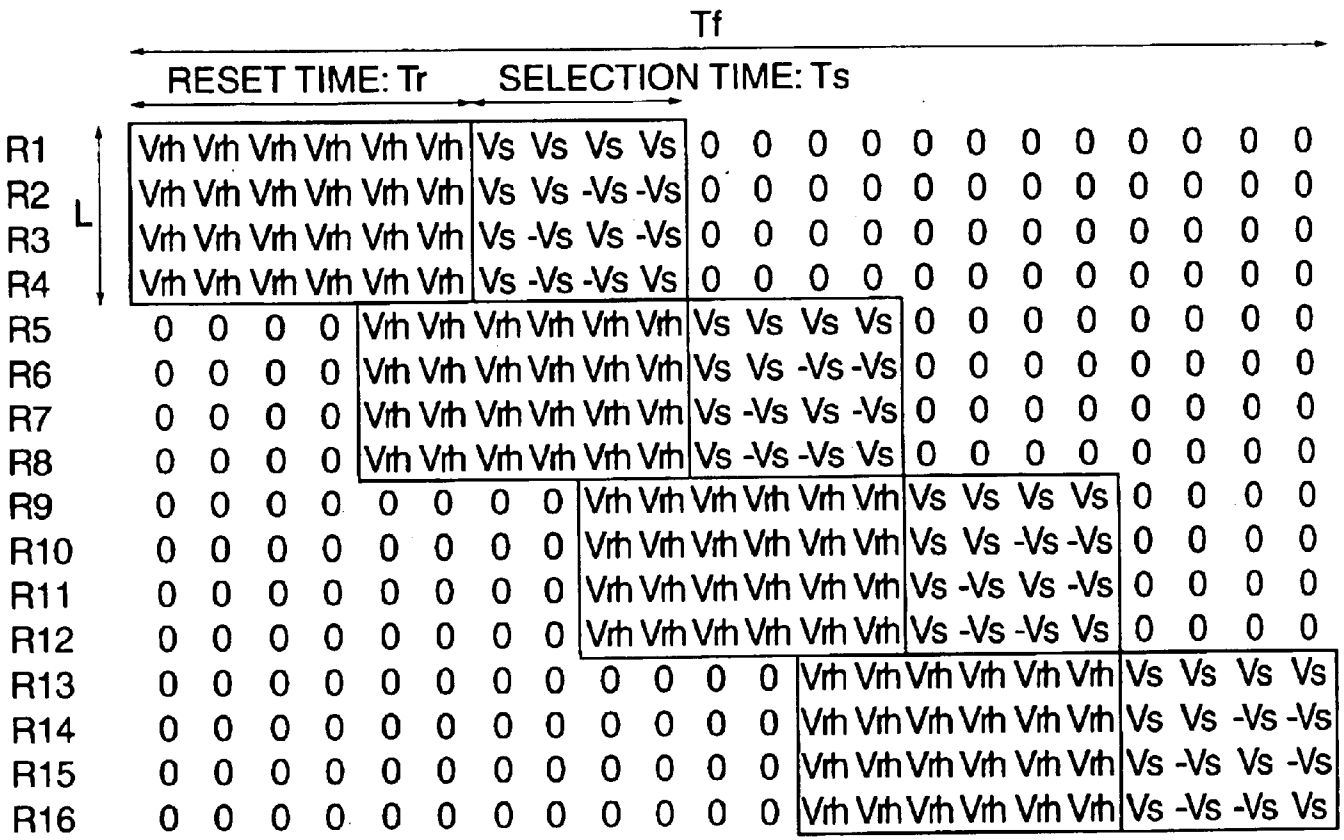
FIG. 7 is a timing chart of the voltages given to the scan-electrodes in another embodiment of a cholesteric liquid crystal display according to the invention.

FIG. 7 is a timing chart of the voltages given to the scan-electrodes in the sixth embodiment of the cholesteric liquid crystal display. This embodiment provides, before the selection time Ts, the reset time Tr for making the pixels transition into the H orientation; and, a series of drive voltages are applied sequentially to each block with a shifted timing of the selection time Ts. During the reset time Tr, the voltage Vrh higher than $V_{T4}$ is applied to make all the pixels transition into the H orientation. In turn, the drive voltage is applied in the setting of Von=$V_{T8}$ and Voff=$V_{T1}$.

In this embodiment, the response time from the H orientation to the F orientation is required to be set longer than the orthogonal cycle, and to be set shorter than the selection time. The response time differs depending upon the elasticity constant and viscosity of the liquid crystal, and the applied voltage to the liquid crystal, which is normally some ten ms.

As the voltage vs. reflectance characteristic is shown in FIG. 25, writing the F orientation after resetting to the H orientation is preferable, compared with writing the F orientation after resetting to the P orientation as in the fourth embodiment, because the voltage vs. reflectance characteristic has a greater sharpness and (Von-Voff) can be smaller. Therefore, according to this embodiment, it is possible to take a larger number L of the simultaneously selectable scan-electrodes, whereby the writing time can be shortened.

<Seventh Embodiment>

Figure 8:
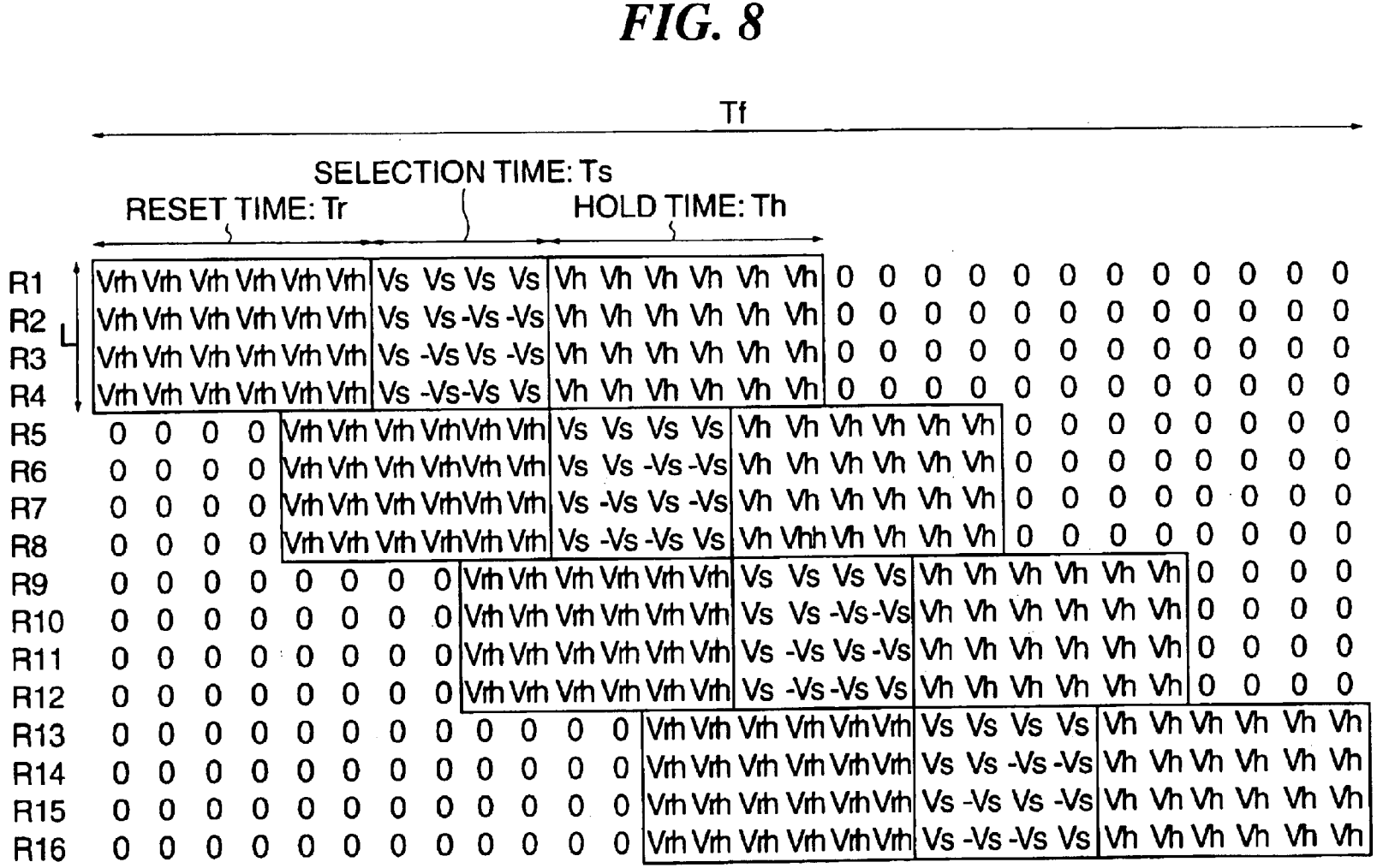
FIG. 8 is a timing chart of the voltages given to the scan-electrodes in another embodiment of a cholesteric liquid crystal display according to the invention.
Figure 9:
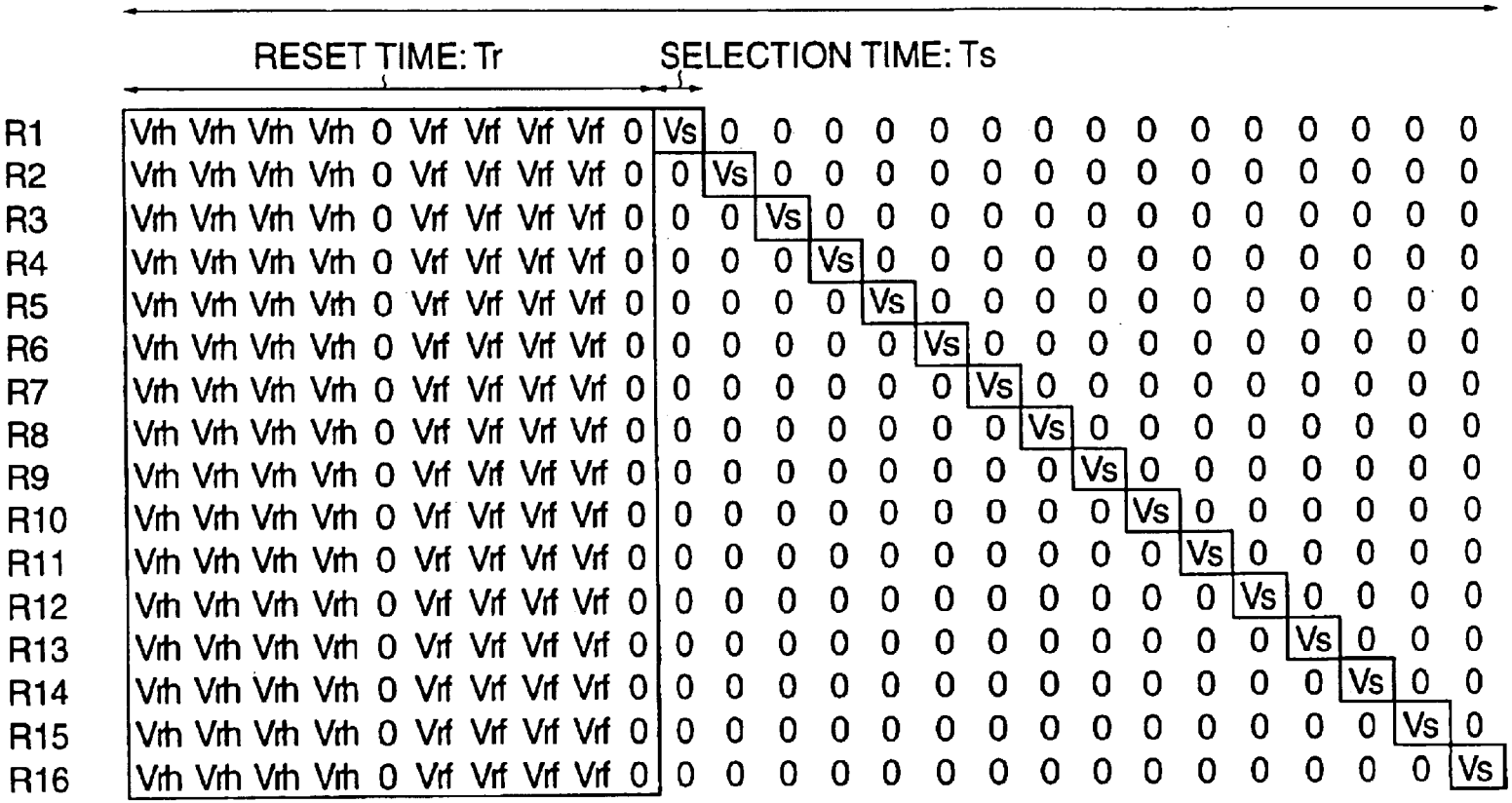
FIG. 9 CONVENTIONAL ART
FIG. 9 is a timing chart of the voltages given to the scan-electrodes in the conventional FCR method.
Figure 10:
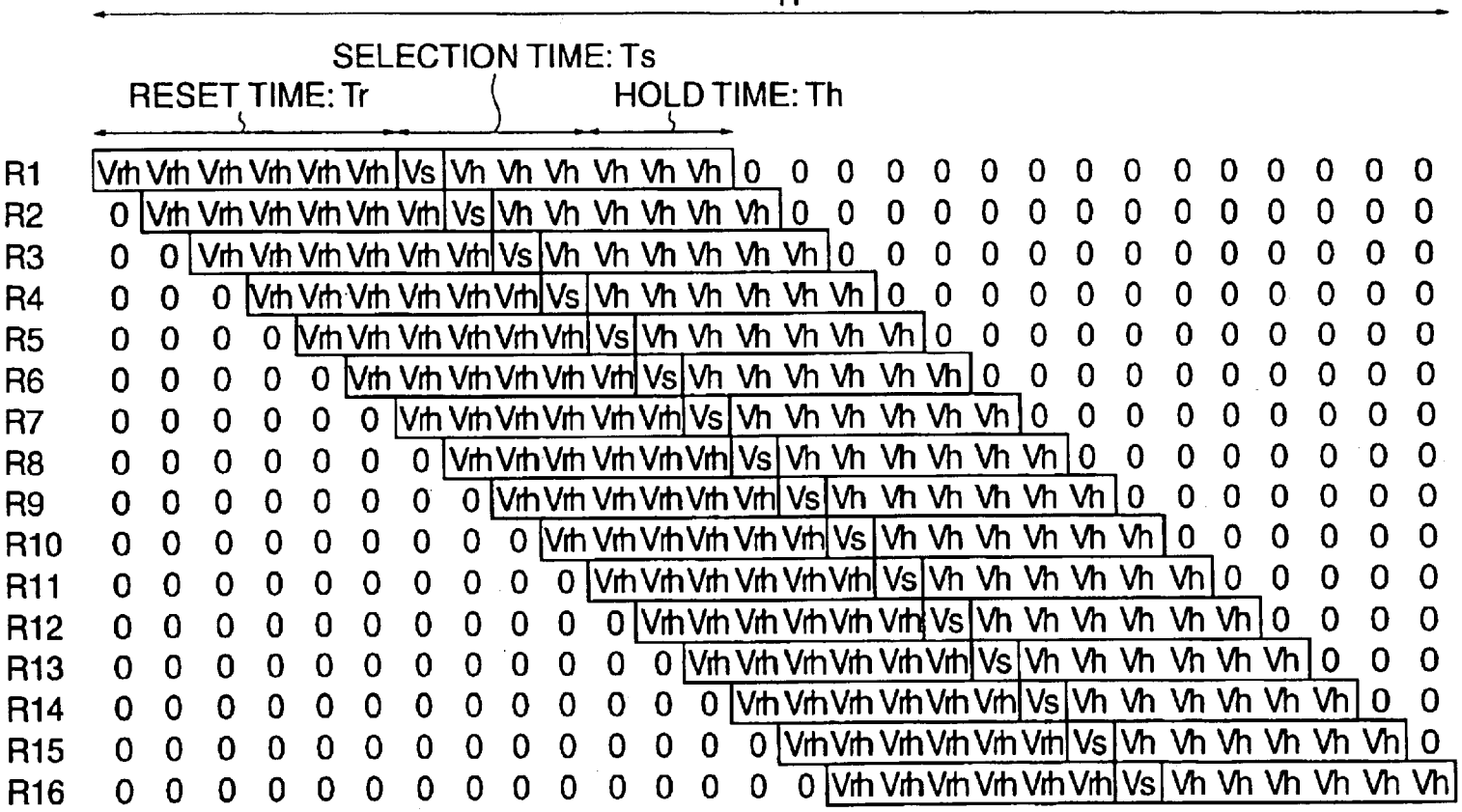
FIG. 10 CONVENTIONAL ART
FIG. 10 is a timing chart of the voltages given to the scan-electrodes in the conventional DDS method.

FIG. 8 is a timing chart of the voltages given to the scan-electrodes in the seventh embodiment of the cholesteric liquid crystal display. This embodiment provides the reset time Tr for making the pixels transition into the H orientation before the selection time Ts, and the hold time Th for supporting the transition into the final orientation state after the selection time Ts. The drive voltages corresponding to a series of the reset time, selection time Ts, and the hold time Th are applied to each block, and a series of the drive voltages are sequentially applied to each block with a shifted timing of the selection time.

In the reset time Tr, the voltage Vrh is applied to the scan-electrodes for the time Tr to make the pixels transition into the H orientation. Here, the voltage applied to the data-electrodes is assumed to be zero. In the selection time Ts, the voltage Vs is set so as to meet Von=$V_{T7}$ and Voff=$V_{T6}$. In the hold time Th, applying the voltage Vh for the time Th maintains the H orientation and makes the TP orientation transition into the F orientation. The pixels with Von applied maintain the H orientation during the selection time Ts, and transitions into the P orientation after the hold time Th to exhibit a high reflectance. The pixels with Voff applied starts to transition into the P orientation by way of the TP orientation in the selection time Ts, and transitions into the F orientation in the hold time Th to exhibit a low reflectance.

In this embodiment, the response time from the H orientation to the TP orientation is required to be set longer than the orthogonal cycle, and to be set shorter than the selection time. The response time differs depending upon the elasticity constant and viscosity of the liquid crystal, and the applied voltage to the liquid crystal, which is normally under ms.

This embodiment can be regarded as one that is configured to simultaneously select L lines of the scan-electrodes in the DDS method. The scan speed in the conventional DDS method is 0.3 ms/line to some ms/line, which is a considerably high speed among the conventional drive methods, however this embodiment is able to increase the speed of the conventional drive by L times.

<Eighth Embodiment>

Figure 13A:
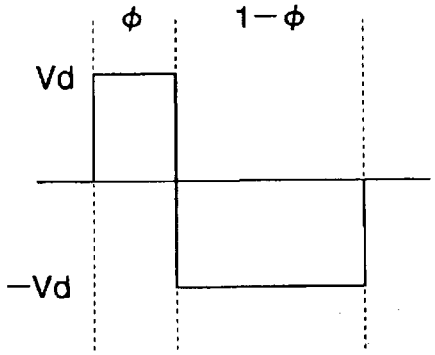
FIG. 13A and FIG. 13B are charts each explaining the voltage waveforms in displaying gradations.
Figure 13B:
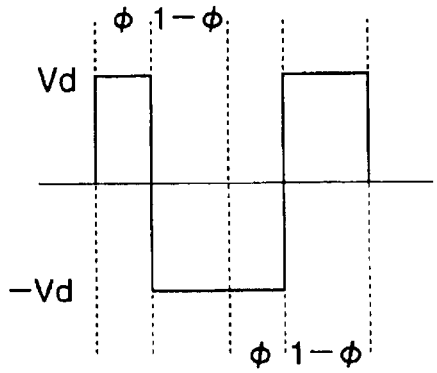

In the first through seventh embodiments, applying a waveform having an arbitrary phase shift $\phi$ as shown in FIG. 13A or FIG. 13B as the pixel data Ui will allow display of the gradations. However, it is presumed to use the waveform in FIG. 13A when selecting the dc rectangular waveform in FIG. 12A, and the waveform in FIG. 13B when selecting the dc rectangular waveform in FIG. 12B, in correspondence with the orthogonal function elements +1 and −1. The pixel data Ui=+Vd corresponds to $\phi$=1, and Ui=−Vd corresponds to $\phi$=0.

To select arbitrary values between 0 and 1 as $\phi$ will add arbitrary effective voltages between Von and Voff to the pixels.

Thus, the invention is able to provide a cholesteric liquid crystal display capable of rewriting at a high speed.

The entire disclosure of Japanese Patent Application No. 2000-230612 filed on Jul. 31, 2000 including specification, claims, drawings and abstract is incorporated herein by reference in its entirety.

What is claimed is:

1. A cholesteric liquid crystal display comprising:

a cholesteric liquid crystal display element forming pixels at intersection portions of scan-electrodes of a scan-electrode group and data-electrodes of a data-electrode group; and a drive circuit that comprises an orthogonal function generator and that sequentially selects scan-electrodes of the scan-electrode group as a block composed of plural scan-electrodes, simultaneously applies corresponding coded drive voltages to the plural scan-electrodes, respectively, in the block in a selection time, and applies corresponding coded data-voltages to the data-electrodes of the data-electrode group, respectively, synchronously with the drive voltages; wherein a response time for a liquid crystal to undergo a transformation when a voltage applied is lower than or equal to the selection time; and the response time is greater than an orthogonal cycle.

2. The cholesteric liquid crystal display according to claim 1, wherein the drive voltages have, during a time over 50% of the selection time, a peak value equal to or higher than a voltage that makes the pixels transition into the homeotropic orientation, and are coded by means of an orthogonal function or a substantially orthogonal function.

3. The cholesteric liquid crystal display according to claim 2, wherein the orthogonal function takes +1 and −1 as elements.

4. The cholesteric liquid crystal display according to claim 1, wherein the data-voltages are coded by multiplying an orthogonal function or a substantially orthogonal function by a pixel data value.

5. The cholesteric liquid crystal display according to claim 2, wherein the selection time includes plural orthogonal cycles that represent a time for satisfying an orthogonal condition of the orthogonal function.

6. The cholesteric liquid crystal display according to claim 5, wherein a response time of a liquid crystal to an effective voltage that is applied to the pixels within the selection time is equal to or longer than one of the orthogonal cycles, and equal to or shorter than the selection time.

7. The cholesteric liquid crystal display according to claim 1, wherein an effective voltage applied to the pixels within a non-selection time is smaller than a threshold voltage that allows maintenance of a bi-stable state with a planar orientation and a focal conic orientation.

8. The cholesteric liquid crystal display according to claim 1, wherein a reset time for making the pixels transition into an initial orientation is provided before the selection time.

9. The cholesteric liquid crystal display according to claim 8, wherein the reset time is given simultaneously to all the blocks.

10. The cholesteric liquid crystal display according to claim 8, wherein the reset time is given to each block sequentially with a shifted timing.

11. The cholesteric liquid crystal display according to claim 8, wherein a hold time for supporting a transition into a final orientation state is provided after the selection time.

12. The cholesteric liquid crystal display according to claim 1, wherein the block is composed of plural spatially separated scan-electrodes.

13. An image-writing device that writes an image in a cholesteric liquid crystal display element forming pixels at intersection portions of scan-electrodes of a scan-electrode group and data-electrodes of a data-electrode group, the device comprising:

an orthogonal function generating circuit that generates an orthogonal function;

a scan-voltage composing circuit that generates scan-voltages by level-shifting the orthogonal function, the scan-voltages being sequentially applied to each of plural scan-electrodes of the scan-electrode group; and a data-voltage composing circuit that generates data-voltages by level-shifting a value obtained by multiplying the orthogonal function by a pixel data value, the data-voltages being applied to the data-electrodes of the data-electrode group; wherein a response time of a liquid crystal to undergo a transformation when a voltage applied is lower than or equal to the selection time; and the response time is greater than an orthogonal cycle.

14. The image-writing device according to claim 13, further comprising a scan-electrode driver capable of applying the scan-voltages to each of plural spatially-separated scan-electrodes of the scan-electrode group.

15. The image-writing device according to claim 13, further comprising a reset waveform generating circuit that applies a reset waveform to the scan-electrodes of the scan-electrode group and the data-electrodes of the data-electrode group through the scan-voltage composing circuit and the data-voltage composing circuit, respectively, before applying the scan-voltages.

16. The image-writing device according to claim 13, wherein a waveform having an arbitrary phase shift is applied as the pixel data value.

17. An image-writing method that writes an image in a cholesteric liquid crystal display element forming pixels at intersection portions of scan-electrodes of a scan-electrode group and data-electrodes of a data-electrode group and comprising an orthogonal function generator, the method comprising the steps of:

sequentially selecting scan-electrodes of the scan-electrode group as a block composed of plural scan-electrodes;

simultaneously applying corresponding coded drive voltages to the plural scan-electrodes, respectively, in the selected block; and applying corresponding coded data-voltages to the data-electrodes of the data-electrode group synchronously with the drive voltages; wherein a response time of a liquid crystal to undergo a transformation when a voltage applied is lower than or equal to the selection time; and the response time is greater than an orthogonal cycle.

18. The image-writing method according to claim 17, wherein the drive voltages are attained by level-shifting an orthogonal function that takes +1 and −1 as elements.

* * * * *